United States Patent [19]

Sasaki et al.

[11] Patent Number: 4,975,359

[45] Date of Patent: Dec. 4, 1990

[54] PHOTOGRAPHIC LIGHT-SENSITIVE MATERIALS CONTAINING COUPLERS THAT RELEASE DIFFUSIBLE DYES AND DIR COMPOUNDS

[75] Inventors: Noboru Sasaki; Kei Sakanoue; Seiji Ichijima; Hidetoshi Kobayashi; Keiichi Adachi, all of Kanagawa, Japan

[73] Assignee: Fuji Photo Film Co., Ltd., Kanagawa, Japan

[21] Appl. No.: 349,457

[22] Filed: May 9, 1989

Related U.S. Application Data

[60] Division of Ser. No. 42,557, Apr. 24, 1987, abandoned, which is a continuation of Ser. No. 679,740, Dec. 10, 1984, abandoned, which is a continuation-in-part of Ser. No. 503,440, Jun. 13, 1983, abandoned.

[30] Foreign Application Priority Data

Jun. 11, 1982 [JP] Japan ..... 57-101226

[51] Int. Cl.[5] ..... G03C 7/20; G03C 7/32

[52] U.S. Cl. ..... 430/509; 430/505; 430/506; 430/544; 430/549

[58] Field of Search ..... 430/504, 505, 506, 509, 430/549, 226

[56] References Cited

U.S. PATENT DOCUMENTS

| | | | |
|---|---|---|---|
| 3,227,554 | 1/1966 | Barr et al. | 96/55 |
| 3,379,529 | 4/1968 | Porter et al. | 96/36 |
| 3,617,291 | 11/1971 | Sawdey | 96/100 |
| 3,632,345 | 1/1972 | Marz | 96/95 |
| 4,345,025 | 8/1982 | Yagihara et al. | 430/385 |
| 4,774,053 | 9/1988 | Nakagawa et al. | 430/504 |

FOREIGN PATENT DOCUMENTS

| | | |
|---|---|---|
| 1949591 | 4/1970 | Fed. Rep. of Germany . |
| 1560852 | 3/1968 | France . |
| 2007360 | 1/1970 | France . |
| 52-82423 | 9/1977 | Japan . |
| 1066352 | 4/1967 | United Kingdom . |
| 2083640 | 3/1982 | United Kingdom . |

OTHER PUBLICATIONS

Research Disclosure 19627, Aug. 1980.
Research Disclosure 17643, Dec. 1978.

*Primary Examiner*—Richard L. Schilling
*Attorney, Agent, or Firm*—Sughrue, Mion, Zinn, Macpeak & Seas

[57] ABSTRACT

A silver halide color photographic light-sensitive material is described, containing: (1) a non-diffusing coupler forming a dye on reacting with an oxidation product of a color developing agent, said dye having diffusibiity of the extent that it exhibits controlled smearing; and (2) a DIR compound releasing a diffusing development inhibitor or its precursor through a coupling reaction. This light-sensitive material is improved in both granularity and sharpness, and has high sensitivity.

2 Claims, No Drawings

PHOTOGRAPHIC LIGHT-SENSITIVE MATERIALS CONTAINING COUPLERS THAT RELEASE DIFFUSIBLE DYES AND DIR COMPOUNDS

This is a division of application Ser. No. 07/042,557 filed on Apr. 24, 1987, now abandoned, which is a continuation of application Ser. No. 06/679,740, filed Dec. 10, 1984, now abandoned, which is a continuation-in-part application of Ser. No. 06/503,440 filed June 13, 1983 (now abandoned).

FIELD OF THE INVENTION

The present invention relates to silver halide color photographic light-sensitive materials (hereinafter sometimes referred to as "color photographic light-sensitive materials"), and more particularly, to color photographic light-sensitive materials for photographing or taking pictures in which both granularity and sharpness are improved.

BACKGROUND OF THE INVENTION

Recently, with increasing sensitivity of color photographic light-sensitive materials, night photographing and photographing of sport scenes, etc., in which a high speed shutter is needed have become possible Moreover, the portability of cameras has been increased by miniaturization of films. This is due to an advance in techniques to improve granularity, resolving power, and sharpness.

The reason for this is as follows:

As is well known, in order to increase the sensitivity of silver halide light-sensitive material, it is necessary to increase the size of silver halide particles. This will lead to a reduction in granularity and a decrease in resolving power. When a negative film is miniaturized, the degree of enlargement at the step of printing must be increased. This will inevitably lead to a reduction in granularity and decreases in resolving power and sharpness.

Thus, in order to further increase the sensitivity of films and expedite the miniaturization, it is necessary to develop greatly advanced techniques.

Various methods for increasing the granularity and sharpness of color photographic light-sensitive materials have heretofore been known. For example, a technique for increasing granularity is disclosed in U.S. Pat. No. 3,726,681 which discloses a method in which in an emulsion layer of higher sensitivity of two layers which are sensitive to the same color, a coupler undergoing a coupling reaction at a higher rate is used, and in the other emulsion layer of lower sensitivity, a coupler having a lower rate of coupling reaction is used. U.S. Pat. No. 3,843,369 discloses a light-sensitive material in which at least one of blue-sensitive, green-sensitive and red-sensitive layers is composed of three layers, the top and intermediate layers of which have a color density of up to 0.60; and British Patent No. 2,083,640A discloses a method in which such couplers which produce slightly diffusing dyes through a coupling reaction are used to provide controlled smearing to dye cloud. The last technique is certainly effective for improving granularity, but it has such a defect that the sharpness grows worse. Therefore, the recent request on improvement of both granularity and sharpness is not sufficiently satisfactory.

A technique of increasing sharpness is described in U.S. Pat. No. 3,409,433 in which films are dyed with water-soluble dyes to prevent irradiation. A method described in U.S. Pat. Nos. 3,148,062 and 3,227,554 uses compounds which undergo a coupling reaction with oxidation products of color developing agents, producing dyes and at the same time, releasing development inhibitors; and a method described in U.S. Pat. No. 3,632,345 in which substances capable of coupling with oxidation products of developing agents, releasing development inhibitors without the formation of dyes are used (these compounds have heretofore been called "DIR compounds"). In addition, U.S. Pat. No. 4,248,962 and Japanese Patent Application (OPI) No. 56837/72 (the term "OPI" as used herein refers to a "published unexamined Japanese patent application") disclose a method for improving sharpness with using DIR compounds releasing development inhibitors having high diffusibility. This method can improve sharpness to a certain extent, but this improvement is not yet sufficiently satisfactory. Conversely, the use of such DIR compounds releasing development inhibitors having high diffusibility gives rise to the problem that granularity is rather reduced.

In view of the above-described technical situation, difficulties are encountered in improving sharpness and granularity simultaneously. This is because when compounds to improve sharpness and granularity are used in combination, they exert adverse influences on each other, reducing their own effects.

SUMMARY OF THE INVENTION

An object of the invention is to provide silver halide color photographic light-sensitive materials which are greatly improved in both granularity and sharpness.

Another object of the invention is to provide silver halide color negative films which have high sensitivity and are excellent in both granularity and sharpness.

As a result of extensive investigations on material and layer structure, it has been found that both sharpness and granularity can be greatly improved by using certain types of couplers and DIR compounds simultaneously.

The present invention relates to a silver halide color photographic light-sensitive material containing: (1) a non-diffusing coupler forming a dye on reacting with an oxidation product of a color developing agent, said dye having diffusibility of the extent that it exhibits controlled smearing, and (2) a DIR compound releasing a diffusing development inhibitor or a diffusing development inhibitor precursor through a coupling reaction This non-diffusing coupler (1) is hereinafter referred to as a diffusing dye-forming coupler, and the DIR compound (2) as a diffusing DIR compound An important aspect of the present invention is that the non-diffusing coupler capable of forming a dye upon reacting with an oxidation product of a color developing agent yield a dye having diffusibility to the extent that it exhibits controlled smearing but it does not diffuse to a different layer.

DETAILED DESCRIPTION OF THE INVENTION

The diffusing dye-forming coupler and the diffusing DIR compound may be used in the same layer, or may be used separately in a plurality of layers which are sensitive to the same color. For example, when used in a two layer structure in the latter case, it may be arranged so that the diffusing dye-forming coupler is used in a layer of higher sensitivity, and the diffusing DIR compound in a layer of lower sensitivity. When used in a three layer structure, it may be arranged so that the diffusing dye-forming coupler is used in a layer of intermediate sensitivity, and the diffusing DIR compound in a layer of lower sensitivity In addition, they may be added to layers which are sensitive to different colors. It is preferred, however, that they are used in a group of layers having the same color sensitivity As earlier indicated, it is necessary per the present invention that the dye released by the non-diffusing coupler have diffusibility to the extent that it exhibits controlled smearing but it does not diffuse to a different layer.

Thus, the present invention is quite different from photographic elements as are disclosed in U. S. Pat. No. 3,733,201 Barr et al where the dyes disclosed always contain an acidic solubilizing radical, as is mandated by the definition of SOL in Barr et al. Due to this radical, the dye formed per Barr et al dissolves in an alkaline developing solution which is used, i.e., a receiving layer and a mordant layer are essential in Barr et al and it is, accordingly, always the case that the dye formed per Barr et al does not remain in the emulsion layer in which the coupler was present. The situation per the present invention is directly contrary This is a consequence of the fact that the coupler of the present invention is such that the dye formed remains in the emulsion layer and the dye formed does not have an acidic solubilizing radical, whereby a dye which dissolves in an alkaline developing solution to any substantial extent does not result.

The above aspect of the present invention is illustrated by Samples 103 and 104 which have nearly equal gradation, which establishes that the dye formed does not diffuse to any other layers. Thus, coupler (M-3) of the present invention only forms a dye which has extremely limited diffusibility to the extent that it does not diffuse to other layers, as is the case with couplers (C-7) in Example 2, and couplers (C-2) and (D-16) of Example 4.

The amount of the diffusing DIR compound added is from 0.0001 to 0.05 mole, preferably from 0.0003 to 0.01 mole,per mole of silver halide.

DIR compounds releasing a development inhibitor or its precursor of relatively low diffusibility which have heretofore been known may be used in combination in the same layer or different layers.

The diffusing dye-forming coupler may be used in combination with the usual couplers forming non-diffusing dye in the same layer or different layers.

The activity of the diffusing DIR compound may be the same as or different from that of the coexisting coupler.

The amount of the diffusing dye-forming coupler being added is from 0.005 to 0.2 mole, preferably from 0.01 to 0.05 mole, per mole of silver The ratio of the diffusing DIR compound to the diffusing dye-forming coupler is from 0.001:1 to 0.3:1 and preferably from 0.005:1 to 0.1:1.

Diffusing dye-forming couplers as used herein include those compounds represented by the general formula (1):

$$(C_p)_a X$$

wherein $C_p$ represents a diffusible coupler component which allows a dye image to exhibit controlled smearing and improve granularity, X represents a ballast group containing from 8 to 32 carbon atoms which is bound to the coupler component at the coupling position and is released through a reaction with an oxidation product of a color developing agent, and a is 1 or 2.

Of the couplers represented by the general formula (1), preferred couplers are represented by the following general formulae:

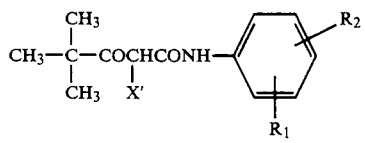

(I)

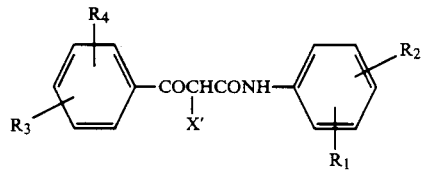

(II)

In the foregoing general formulae (I) and (II), $R_1$, $R_2$, $R_3$ and $R_4$ may be the same or different, and are each a hydrogen atom, a halogen atom, an alkyl group (e.g., a methyl group, an ethyl group, an isopropyl group, and a hydroxyethyl group), an alkoxy group (e.g., a methoxy group, an ethoxy group, and a methoxyethoxy group), an aryloxy group (e.g., a phenoxy group), an acylamino group (e.g., an acetylamino group, and a trifluoroacetylamino group), a sulfonamino group (e.g., a methanesulfonamino group, and a benzenesulfonamino group), a carbamoyl group, a sulfamoyl group, an alkylthio group, an alkylsulfonyl group, an alkoxycarbonyl group, a ureido group, a cyano group, a carboxyl group, a hydroxy group, or a sulfo group, provided that the total number of carbon atoms contained in $R_1$, $R_2$, $R_3$ and $R_4$ is not more than 10, and X' is a group which contains a so-called ballast group containing from 8 to 32 carbon atoms, providing non-diffusibility to the coupler, and which is capable of being released through a coupling reaction with an oxidation product of an aromatic primary amine developer.

In more detail, the group X' can be represented by the following general formula (III) or (IV):

(III)

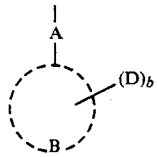

(IV)

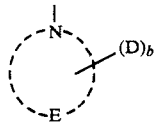

In the foregoing formulae (III) and (IV), A represents an oxygen atom or a sulfur atom, B represents a non-metal atom group required for forming an aryl ring or a heterocyclic ring (preferably a 5- or 6-membered heterocyclic ring), and E represents a non-metal atom group required for forming a 5- or 6-membered heterocyclic ring in combination with a nitrogen atom. These rings may further condense with an aryl ring or a heterocyclic ring. D represents a ballast group, and b is a positive integer. When b is more than 1, D may be the same or different, and the total number of carbon atoms is from 8 to 32. D may contain connecting or linking groups, e.g., —O—, —S—, —COO—, —CONH—, —$SO_2$N-H——NHCONH——$SO_2$—, —CO—, and —NH—.

Of the couplers represented by the general formula (1) preferred additional compounds are represented by the following formulae (V), (VI) and (VII):

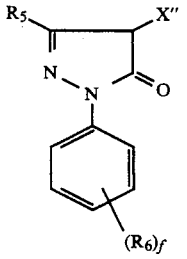
(V)

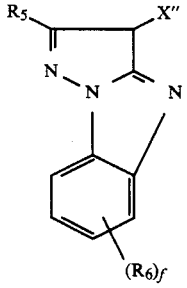
(VI)

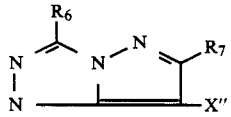
(VII)

In the foregoing formulae (V), (VI) and (VII), $R_5$ is an acylamino group (e.g., a propanamido group and a benzamido group), an anilino group (e.g., a 2-chloroanilino group and a 5-acetamidoanilino group), or a ureido group (e.g., a phenylureido group and a butane-ureido group), $R_6$ and $R_7$ are each selected from a halogen atom, an alkyl group (e.g., a methyl group and an ethyl group), an alkoxy group (e.g., a methoxy group and an ethoxy group), an acylamino group (e.g., an acetamido group and a benzamido group), an alkoxycarbonyl group (e.g., a methoxycarbonyl group), an N-alkylcarbamoyl group (e.g., an N-methylcarbamoyl group), a ureido group (e.g., an N-methylureido group), a cyano group, an aryl group (e.g., a phenyl group and a naphthyl group), an N-dialkylsulfamoyl group, a nitro group, a hydroxyl group, a carboxyl group, an aryloxy group, etc., and f is an integer of from 0 to 4. When f is 2 or more, $R_6$ may be the same or different. In the general formulae (V) and (VI), however, the total number of carbon atoms contained in $R_5$ and $(R_6)_f$ does not exceed 10, and in the general formula (VII), the total number of carbon atoms in $R_6$ and $R_7$ does not exceed 10. X″ represents the following general formula (VIII), (IX) or (X):

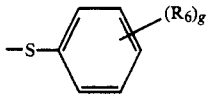
(VIII)

-continued

—S—$R_8$ (IX)

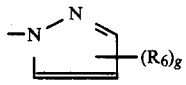
(X)

In the foregoing formulae (VIII) and (X), $R_6$ is selected from the groups described in the general formulae (V) to (VII), and when g is 2 or more, $R_6$ may be the same or different. The total number of carbon atoms contained in $(R_6)_g$ is from 8 to 32.

$R_8$ may be substituted or unsubstituted, and is an alkyl group (e.g., a butyl group and a dodecyl group), an aralkyl group (e.g., a benzyl group), an alkenyl group (e.g., an allyl group), or a cyclic alkyl group (e.g., a cyclopentyl group). Substituents which can be used include a halogen atom, an alkoxy group (e.g., a butoxy group and a dodecyloxy group), an acylamido group (e.g., an acetamido group and a tetradecanamido group), an alkoxycarbonyl group (e.g., a tetradecyloxycarbonyl group), an N-alkylcarbamoyl group (e.g., an N-dodecylcarbamoyl group), a ureido group (a tetradecylureido group), a cyano group, an aryl group (e.g., a phenyl group), a nitro group, an alkylthio group (e.g., a dodecylthio group), an alkylsulfinyl group (e.g., a tetradecylsulfinyl group), an alkylsulfone group, an anilino group, a sulfonamido group (e.g., a hexadecanesulfonamido group), an N-alkylsulfamoyl group, an aryloxy group, and an acyl group (e.g., a tetradecanoyl group). The total number of carbon atoms contained in $R_8$ is from 8 to 32.

Of the couplers represented by the general formula (1) additional compounds which are preferred are represented by the following general formulae (XI) and (XII):

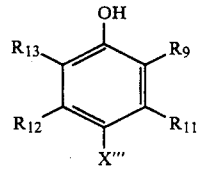
(XI)

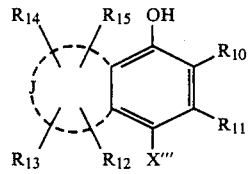
(XII)

In the foregoing formulae (XI) and (XII), $R_9$ is a hydrogen atom, an aliphatic group containing 10 or less carbon atoms (e.g., an alkyl group such as methyl, isopropyl, acyl, cyclohexyl, or octyl), an alkoxy group containing 10 or less carbon atoms (e.g., methoxy, isopropoxy and pentadecyloxy), an aryloxy group (e.g., phenoxy and p-tert-butylphenoxy), an acylamido group, a sulfonamido group and a ureido group represented by the general formulae (XIII) to (XV) as described below, or a carbamoyl group represented by the general formula (XVI) as described below.

—NH—CO—G (XIII)

—NH—$SO_2$—G (XIV)

—NHCONH—G (XV)

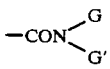

(XVI)

wherein G and G' may e the same or different, and are each a hydrogen atom (provided that G and G' are not hydrogen atoms at the same time and that the total number of carbon atoms contained in G and G' is from 1 to 12), an aliphatic group containing from 1 to 12 carbon atoms, preferably a straight or branched alkyl group, or a cyclic alkyl group (e.g., cyclopropyl, cyclohexyl and norbornyl), containing from 4 to 10 carbon atoms, or an aryl group (e.g., phenyl and naphthyl); the alkyl and aryl groups may be substituted by a halogen atom (e.g., fluorine and chlorine), a nitro group, a cyano group, a hydroxy group, a carboxy group, an amino group (e.g., amino, alkylamino, dialkylamino, anilino and N-alkylanilino), an alkyl group (e.g., those as described above), an aryl group (e.g., phenyl and acetylaminophenyl), an alkoxycarbonyl group (e.g., butyloxycarbonyl), an acyloxycarbonyl group, an amido group (e.g., acetamido and methanesulfonamido), an imido group (e.g., succinic acid amide), a carbamoyl group (e.g., N,N-diethylcarbamoyl), a sulfamoyl group (e.g., N,N-diethylsulfamoyl), an alkoxy group (e.g., ethoxy, butyloxy and octyloxy), an aryloxy group (e.g., phenoxy and methylphenoxy), etc.

$R_9$ may contain commonly used substituents in addition to the above-described substituents.

$R_{10}$ is a hydrogen atom an aliphatic group containing 12 or less carbon atoms, preferably an alkyl group containing from 1 to 10, or a carbamoyl group represented by the general formula (XVI).

$R_{11}$, $R_{12}$,$R_{13}$,$R_{14}$ and $R_{15}$ are each a hydrogen atom, a halogen atom, an alkyl group, an aryl group, an alkoxy group, an alkylthio group, a heterocyclic group, an amino group, a carbonamido group, a sulfonamido group, a sulfamyl group, or a carbamyl group In greater detail, $R_{11}$ represents:

a hydrogen atom, a halogen atom (e.g., chlorine and bromine), a primary, secondary or tertiary alkyl group containing from 1 to 12 carbon atoms (e.g., methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl-)ethyl, and 2-aminoethyl), an alkylthio group (e.g., octylthio), an aryl group (e.g., phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl and 3-ethylnaphthyl), a heterocyclic ring group (e.g., a benzofuranyl group, a furanyl group, a thiazolyl group, a benzothiazolyl group, a naphthothiazolyl group, an oxazolyl group, a benzoxazolyl group, a naphthoxazolyl group, a pyridyl group and a quinolinyl group), an amino group (e.g , amino, methylamino, diethylamino, dodecylamino, phenylamino, tolylamino, 4-cyanophenylamino, 2-trifluoromethylphenylamino and benzothiazoleamino), a carbonamido group (e.g., alkylcarbonamido such as ethylcarbonamido and decylcarbonamido; arylcarbonamido such as phenylcarbonamido, 2,4,6-trichlorophenylcarbonamido, 4-methylphenylcarbonamido, 2-ethoxyphenylcarbonamido, and naphthylcarbonamido; and heterocyclic carbonamido such as thiazolylcarbonamido, benzothiazolylcarbonamido, naphthothiazolylcarbonamido, oxazolylcarbonamido, benzoxazolylcarbonamido, imidazolylcarbonamido, and benzimidazolylcarbonamido), a sulfonamido group (e.g., alkylsulfonamido such as butylsulfonamido, dodecylsulfonamido and phenylethylsulfonamido; arylsulfonamido such as phenylsulfonamido, 2,4,6-trichlorophenylsulfonamido, 2-methoxyphenylsulfonamido, 3-carboxyphenylsulfonamido and naphthylsulfonamido; and heterocyclic sulfonamido such as thiazolylsulfonamido, benzothiazolylsulfonamido, imidazolylsulfonamido, benzimidazolylsulfonamido, and pyridylsulfonamido), a sulfamyl group (e.g., alkylsulfamyl such as propylsulfamyl, octylsulfamyl; arylsulfamyl such as phenylsulfamyl, 2,4,6-trichlorophenylsulfamyl, 2-methoxyphenylsulfamyl, naphthylsulfamyl; and heterocyclic sulfamyl such as thiazolylsulfamyl, benzothiazolylsulfamyl, oxazolylsulfamyl, benzimidazolylsulfamyl and pyridylsulfamyl), and a carbamyl group (e.g., alkylcarbamyl such as ethylcarbamyl and octylcarbamyl; arylcarbamyl such as phenylcarbamyl; and 2,4,6-trichlorophenylcarbamyl, and heterocyclic carbamyl groups, such as thiazolylcarbamyl, benzothiazolylcarbamyl, oxazolylcarbamyl, imidazolylcarbamyl, and benzimidazolylcarbamyl).

$R_{12}$, $R_{13}$, $R_{14}$ and $R_{15}$ can be the compounds described in detail in $R_{11}$.

J represents a non-metal group necessary for forming a 5- or 6-membered ring, e.g., a benzene ring, a cyclohexene ring, a cyclopentene ring, a thiazole ring, an oxazole ring, an imidazole ring, a pyridine ring, and a pyrrole ring. Of these rings, a benzene ring is preferred.

X''' represents a group which contains from 8 to 32 carbon atoms, is bound through —O—, —S—, or —N=N—to the coupling position, and is capable of being released through a coupling reaction with an oxidation product of an aromatic primary amine developer. Preferred examples are an alkoxy group, an aryloxy group, an alkylthio group, and an arylthio group, containing from 8 to 32 carbon atoms These groups may further contain divalent groups such as —O—, —S—, —NH—, —CONH—, —COO—, —$SO_2$NH—, —SO—, —SO —, —CO—,

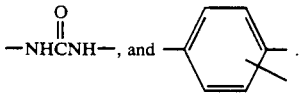

Moreover, it is particularly preferred that the groups contain such groups as —COOH, —$SO_3$H, —OH and —$SO_2NH_2$, which are dissociated by alkali.

By suitably combining R , $R_{10}$, $R_{11}$, $R_{12}$, $R_{13}$, $R_{14}$, $R_{15}$, and X''', couplers can be made substantially nondiffusing. For example, couplers can be made nondiffusing by sole substituent containing from 8 to 32 carbon atoms or two or more substituents which effect each other and show the same result as that of the substituent containing from 8 to 32 carbon atoms due to the combination thereof Diffusing DIR compounds as used herein include those compounds represented by the general formula (XVII):

$J(Y)_h$ (XVII)

wherein J represents a coupler component, h is 1 or 2, and Y represents a group which is bound to the coupler component, J, at the coupling position thereof, and is capable of being released through a reaction with an oxidation product of a color developing agent, providing a development inhibitor or development inhibitor precursor having high diffusibility (preferably having a degree of diffusion of at least 0.4 as determined by the method as described hereinafter).

In greater detail, the group, Y, of the general formula (XVII) is represented by the general formula (XVIII), (XIX), (XX) or (XXI).

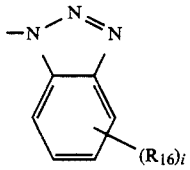
(XVIII)

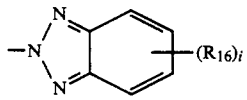
(XIX)

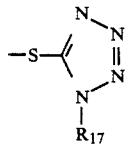
(XX)

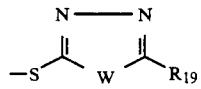
(XXI)

In the foregoing formulae (XVIII), (XIX) (XX) and (XXI), W represents —S—or —N($R_{18}$)—, and $R_{16}$, $R_{17}$, $R_{18}$ and $R_{19}$ are each a substituent selected so that the degree of diffusion is at least 0.4, and i is from 1 to 4.

Examples for $R_{16}$ include $CH_3$—(provided that i=2), Br (provided that i=1; hereinafter the same in all cases), —NHCOR′ (wherein R′ contains from 3 to 7 carbon atoms), —$NHSO_2R'$ (wherein R′ contains from 4 to 8 carbon atoms), —OR′ (wherein R′ contains from 2 to 5 carbon atoms), —R′ (containing from 1 to 3 carbon atoms),

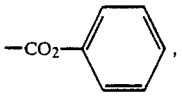

and —$CO_2R'$, (wherein R′ contains from 2 to 6 carbon atoms). The —R′ group represents a substituted or unsubstituted straight, cyclic or branched aliphatic group.

Examples of $R_{17}$ include an ethyl group, a propyl group, a hydroxyl group-substituted phenyl group, an amino group-substituted phenyl group, a sulfamoyl group-substituted phenyl group, a carboxyl group-substituted phenyl group, a methoxycarbonyl group-substituted phenyl group, a 3-methoxyphenyl group, —$(CH_2)_{2-3}COOR'$ (wherein R′ contains from 2 to 3 carbon atoms), —$(CH_2)_{2-3}N(R')_2$ (wherein R′ may be the same or different, and contains from 2 to 3 carbon atoms), —$(CH_2)_2OCH_3$, a 3-carbamoylphenyl group, and a 3-ureidophenyl group. R′ is the same as defined in $R_{16}$.

Examples of $R_{18}$ include a hydrogen atom, and an alkyl group containing from 1 to 4 carbon atoms.

Examples of $R_{19}$ include an amino group, —NHCOR′ (wherein R′ contains from 1 to 6 carbon atoms) —$NHCH_2CH_2N(R')_2$ (wherein R′ may be the same or different, and represents a methyl group or an ethyl group), an ethyl group, a propyl group, —$(CH_2)_{2-3}COOH$, and —$(CH_2)_{2-4}SO_3H$.

The diffusibility of development inhibitors is determined as follows:

A two layer structure light-sensitive material comprising a transparent support and the first and second emulsion layers as described below is produced. This material is called "Sample B".

First Layer: Red-Sensitive Silver Halide Emulsion Layer

A gelatin coating solution containing an emulsion which is made red-sensitive by adding Sensitizing Dye I of Example 1 to a silver iodobromide emulsion (silver iodide: 5 mole%; mean grain size: 0.4 μ) in an amount of $6\times10^{-5}$ mole per mole of silver, and Coupler X as described below in the amount of 0.0015 mole per mole of silver is coated so that the amount of silver coated is 1.8 g/m² (film thickness: 2 μ).

Coupler X

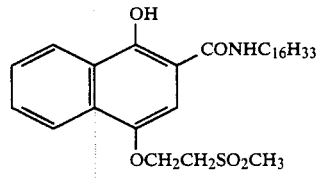

Second Layer

Gelatin layer containing the same silver iodobromide emulsion as used in the preparation of the first layer (not having red sensitivity), and polymethyl methacrylate (diameter: about 1.5 μ) (amount of silver coated 2 g/m²; film thickness: 1.5 μ).

In addition, each layer contains a gelatin hardening agent and a surfactant.

A light-sensitive material of the same structure as Sample B except that the second layer does not contain the silver iodobromide emulsion is produced. This material is called "Sample A".

Samples A and B are each exposed wedgewise and, thereafter, processed in the same manner as in Example 1 as described hereinafter except that the developing time is changed to 130 seconds A development inhibitor is added to a developer until the density of Sample A falls to one-half the original value. The degree of reduction in density of Sample B at that time is used as a measure of diffusibility in the silver halide emulsion film The results are shown in Table 1 below

TABLE 1

| Degree of Diffusion of Development Inhibitors | | | | |
|---|---|---|---|---|
| Development Inhibitor | Amount of Developer Added | Rate of Reduction in Density (%) Sample A | Sample B | Degree of Diffusion (B/A) |
| 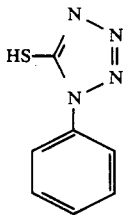 | $0.75 \times 10^{-4}$M | 50 | 10 | 0.2 |
| 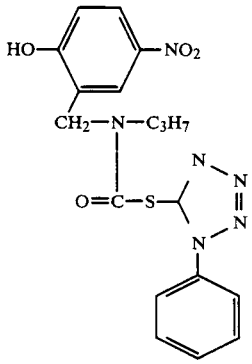 | $1 \times 10^{-4}$ | 50 | 25 | 0.5 |
| 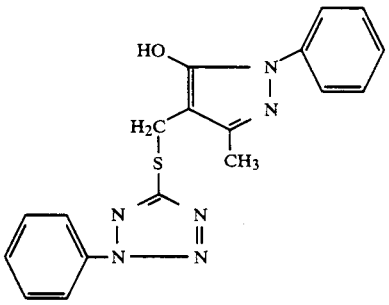 | $0.8 \times 10^{-4}$ | 48 | 20 | 0.42 |
| 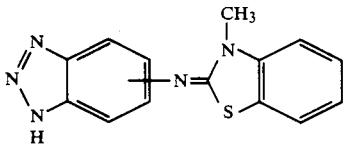 | $0.5 \times 10^{-4}$ | 50 | 15 | 0.3 |
| 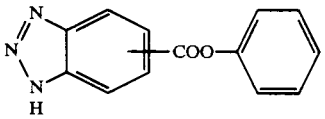 | $2 \times 10^{-4}$ | 52 | 37 | 0.74 |
| 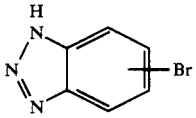 | $2.5 \times 10^{-4}$ | 51 | 45 | 0.9 |

In the general formula (XVII), Y further indicates the following general formula (XXII):

—TIME—INHIBIT (XXII)

wherein the TIME group is a group which is bound to the coupling position of the coupler, and is capable of undergoing cleavage through a reaction with a color developing agent and, after the cleavage from coupler, of releasing the INHIBIT group while controlling appropriately, and the INHIBIT group is a development inhibitor.

Preferred examples of the general formula (XXII) are those represented by the following general formulae (XXIII) to (XXIX):

(XXIII)

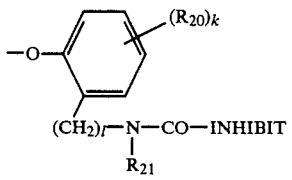

(XXIV)

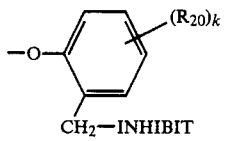

(XXV)

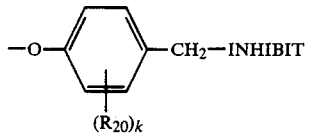

(XXVI)

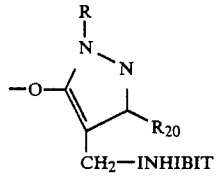

(XXVII)

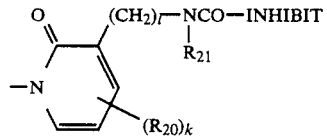

(XXVIII)

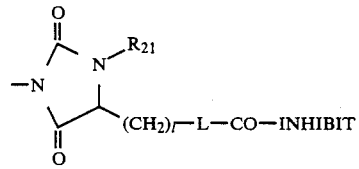

(XXIX)

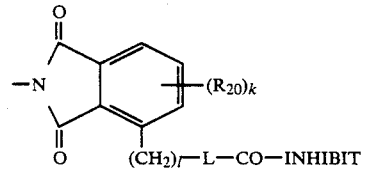

In the foregoing general formulae (XXIII) to (XXIX), $R_{20}$ hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkansulfonyl group In the general formulae (XXIII), (XXIV), (XXV), (XXVII) and (XXIX), k is 1 or 2.

In the general formulae (XXIII), (XXVII), (XXVIII) and (XXIX), l is an integer of from 0 to 2.

In the general formulae (XXIII), (XXVI) and (XXVII), $R_{21}$ is an alkyl group, an alkenyl group, an aralkyl group, a cycloalkyl group, or an aryl group.

In the general formulae (XXVIII) and (XXIX), L represents an oxygen atom, or

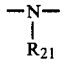

(wherein $R_{21}$ is the same as defined above).

Preferred examples of the INHIBIT group are those represented by the general formulae (XVIII), (XIX), (XX) and (XXI) (wherein $R_{16}$, $R_{17}$, $R_{18}$ and $R_{19}$ are changed to $R'_{16}$, $R'_{17}$, $R'_{18}$ and $R'_{19}$, respectively).

In the general formulae (XVIII) and (XIX), $R'_{16}$ is an alkyl group, an alkoxy group, an acylamino group, a halogen atom, an alkoxycarbonyl group, a thiazolilideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxyl group, an alkoxycarbonylamino group, an alkylthio group, an arylthio group, an aryl group, a heterocyclic group, a cyano group, an alkylsulfonyl group, or an aryloxycarbonylamino group. i is 1 or 2. When i is 2, the two $R'_{16}$ may be the same or different. The total number of carbon atoms in (R' is from 0 to 32.

In the general formula (XX), $R'_{17}$ is an alkyl group, an aryl group, or a heterocyclic group.

In the general formula (XXI), $R'_{18}$ is a hydrogen atom, an alkyl group, an aryl group, or a heterocyclic ring, and $R'_{19}$ is a hydrogen atom, an alkyl group, an aryl group, a halogen atom, an acylamino group, an alkoxycarbonylamino group, an aryloxycarbonylamino group, an alkanesulfonamido group, a cyano group, a heterocyclic ring, an alkylthio group, or an amino group When $R'_{16}$, $R'_{17}$, R'or $R'_{19}$ represents an alkyl group, the alkyl group may be substituted or unsubstituted, or chain-like or cyclic. Substituents include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group, and an arylthio group.

When $R'_{16}$, $R'_{17}$, $R'_{18}$ or $R'_{19}$ is an aryl group, the aryl group may be substituted. Substituents include an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group, and a ureido group.

When $R'_{16}$, $R'_{17}$, $R'_{18}$ or $R'_{19}$ represents a heterocyclic group, the heterocyclic group is a 5- or 6-membered monocyclic or condensed ring containing as a hetero atom a nitrogen atom, an oxygen atom or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group, and an oxazine group. These groups may be substituted by substituents as described for the foregoing aryl group.

In the general formula (XX), the number of carbon atoms contained in R' is from 1 to 32.

In the general formula (XXI), the total number of carbon atoms contained in $R'_{18}$ and $R'_{19}$ is from 1 to 32.

When $R'_{20}$ or $R'_{21}$ represents an alkyl group, the alkyl group may be substituted or unsubstituted, or chain-like or cyclic. As substituents, the ones as described for the alkyl group of $R'_{16}$ to $R'_{19}$ can be given.

When $R'_{20}$ or $R'_{21}$ represents an aryl group, the aryl group may be substituted As substituents, the ones as described for the aryl group of $R'_{16}$ to $R'_{19}$ can be given.

The yellow image-forming coupler residue represented by J in the general formula (XVII) includes coupler residues of pivaloylacetanilide, benzoylacetanilide, malondiester, malondiamide, benzoylmethane, benzothiazolylacetamide, malonester monoamide, benzothiazolyl acetate, benzoxazolylacetamide, benzoxazolyl acetate, benzimidazolylacetamide, and benzimidazolyl acetate types, coupler residues derived from heterocyclic ring-substituted acetamides or heterocyclic ring-substituted acetates as described in U.S. Pat. No. 3,841,880, coupler residues derived from acetylacetamides as described in U.S. Pat. No. 3,770,446, British Patent No. 1,459,171, West German Patent Application (OLS) No. 2,503,099, Japanese Patent Application (OPI) No. 139738/75, and Research Disclosure, No. 15737, and heterocyclic ring type coupler residues as described in U.S. Pat. No. 4,046,574.

As the magenta image-forming coupler residue represented by J, coupler residues containing a 5-oxo-2-pyrazoline nucleus, a pyrazolo[1,5-a]benzimidazole nucleus, or a cyanoacetophenone type coupler residue are preferred.

As the cyan image-forming coupler residue represented by J, coupler residues containing a phenol nucleus or an α-naphthol nucleus are preferred.

In addition, those couplers which undergo a coupling reaction with an oxidation product of a developing agent, releasing a development inhibitor, but not substantially forming dye can be used because their effects as DIR couplers are the same. Coupler residues of this type as represented by J include the ones described in U.S. Pat. Nos. 4,052,213, 4,088,491, 3,632,345, 3,958,993 and 3,961,959.

In the general formula (XVII), preferred examples of J are those groups represented by the following general formulae:

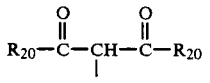
(XXX)

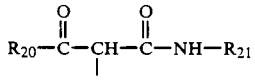
(XXXI)

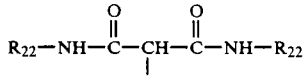
(XXXII)

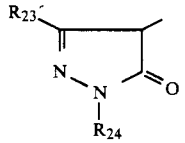
(XXXIII)

-continued

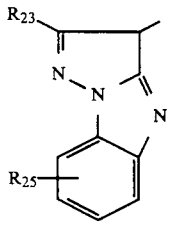
(XXXIV)

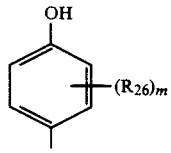
(XXXV)

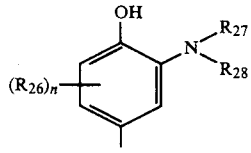
(XXXVI)

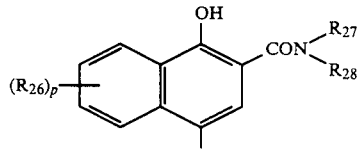
(XXXVII)

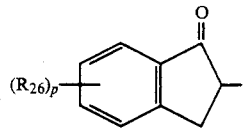
(XXXVIII)

In the foregoing formulae, $R_{20}$ represents an aliphatic group, an aromatic group, an alkoxy group, or a heterocyclic ring, and $R_{21}$ and $R_{22}$ are each an aromatic group, an aliphatic group or a heterocyclic ring.

The aliphatic group represented by $R_{20}$ preferably contains from 1 to 22 carbon atoms, and may be substituted or unsubstituted, or chain-like or cyclic Preferred substituents for an alkyl group include an alkoxy group, an aryloxy group, an amino group, an acylamino group, and a halogen atom. These substituents per se may be substituted.

Suitable examples of the aliphatic groups represented by $R_{20}$, $R_{21}$ and $R_{22}$ are as follows:

An isopropyl group, an isobutyl group a tert-butyl group, an isoamyl group, a tert-amyl group, a 1,1-dimethylbutyl group, a 1,1-dimethylhexyl group, a 1 1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)-isopropyl group, an α-(phthalimido)isopropyl group, and an α-(benzenesulfonamido)isopropyl group.

When $R_{20}$, $R_{21}$ or $R_{22}$ represents an aromatic group (particularly a phenyl group), the aromatic group may be substituted. That is, the aromatic group, e.g., a phenyl group, may be substituted by a group containing 32 or less carbon atoms, e.g., an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, and an alkyl-substituted succinimido group. This alkyl group may contain an aromatic group, e.g., phenylene, in the chain thereof The phenyl group may be substituted by, e.g., an aryloxy group, an aryloxycarbonyl group, an arylcarbamoyl group, an arylamido group, an arylsulfamoyl group, an arylsulfonamido group, and an arylureido group In these substituents, the aryl group portion may be further substituted by at least one alkyl group containing from 1 to 22 carbon atoms in total.

The phenyl group represented by $R_{20}$, $R_{21}$, or $R_{22}$ may be substituted by an amino group which may be further substituted by a lower alkyl group containing from 1 to 6 carbon atoms, a hydroxyl group, a carboxyl group, a sulfo group, a nitro group, a cyano group, a thiocyano group, or a halogen atom.

In addition, $R_{20}$, $R_{21}$ or $R_{22}$ may further represent a substituent resulting from condensation of a phenyl group to another ring, e.g., a naphthyl group, a quinolyl group, an isoquinolyl group, a curomanyl group, a cumaranyl group, and a tetrahydronaphthyl group. These substituents per se may be further substituted.

When $R_{20}$ represents an alkoxy group, the alkyl portion of the alkoxy group contains from 1 to 40 carbon atoms and preferably from 1 to 22 carbon atoms, and is a straight or branched alkyl group, a straight or branched alkenyl group, a cyclic alkyl group, or a cyclic alkenyl group. These groups may be substituted by, e.g., a halogen atom, an aryl group and an alkoxy group.

When $R_{20}$, $R_{21}$ or $R_{22}$ represents a heterocyclic ring, the heterocyclic ring is bound through one of carbon atoms constituting the ring to the carbon atom of the carbonyl group of the acyl group in $\alpha$-acylacetamide or to the nitrogen atom of the amido group in $\alpha$-acylacetamide. Examples of such heterocyclic rings are thiophene, furan, pyran, pyrrole, pyrazole, pyridine, piperadine, pyrimidine, pyridazine, indolizine, imidazole, thiazole, oxazole, triazine, thiazine and oxazine. These heterocyclic rings may have a substituent on the ring thereof.

In the general formula (XXXIII), $R_{24}$ contains from 1 to 40 carbon atoms, preferably from 1 to 22 carbon atoms, and is a straight or branched alkyl group (e.g., methyl, isopropyl, tert-butyl, hexyl and dodecyl), an alkenyl group (e.g., an allyl group), a cyclic alkyl group (e.g., a cyclopentyl group, a cyclohexyl group and a norbornyl group), an aralkyl group (e g., a benzyl group and a $\beta$-phenylethyl group), and a cyclic alkenyl group (e.g., a cyclopentenyl group and a cyclohexenyl group) These groups may be substituted by, e.g., a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group and a mercapto group.

$R_{24}$ may further represent an aryl group, e.g a phenyl group, and an $\alpha$- or $\beta$-naphthyl group. This aryl group contains at least one substituent. These substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and a mercapto group. More preferably, $R_{24}$ is a phenyl group which is substituted by, e.g., an alkyl group, an alkoxy group or a halogen atom, at least one of the ortho positions. Those compounds in which $R_{24}$ is a phenyl group are useful because color-formation due to light or heat of coupler remaining in a film is reduced.

$R_{24}$ may further represent a heterocyclic ring (e.g., 5- or 6-membered heterocyclic or condensed heterocyclic group containing a nitrogen atom, an oxygen atom or a sulfur atom as a hetero atom, such as a pyridyl group, a quinolyl group, a furyl group, a benzothiazolyl group, an oxazolyl group, an imidazolyl group and a naphthoxazolyl group), a heterocyclic ring substituted by the groups described for the aryl group as described above, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_{23}$ is a hydrogen atom, a straight or branched alkyl group containing from 1 to 40 carbon atoms, preferably from 1 to 22 carbon atoms, an alkenyl group, a cyclic alkyl group, an aralkyl group, a cyclic alkenyl group (which may contain substituents as described for $R_{24}$), an aryl group and a heterocyclic group (which may contain substituents as described for $R_{24}$), an alkoxycarbonyl group (e.g., a methoxycarbonyl group, an ethoxycarbonyl group and a stearyloxycarbonyl group), an aryloxycarbonyl group (e.g., a phenoxycarbonyl group, and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group, and a dodecylthio group), an arylthio group (e.g., a phenylthio group and an $\alpha$-naphthylthio group), a carboxyl group, an acylamino group [e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group (e.g., a ureido group and an N-arylureido group), a urethane group, a thiourethane group, an arylamino group (e.g., a phenylamino group, an N-methylanilino group, a diphenylamino group, an N-acetylan.lino group and a 2-chloro-5-tetradecanamidoanilino group), a dialkylamino group (e.g., a dibenzylamino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-piperidylamino group and a 2-benzoxazolylamino group), an alkylcarbonyl group (e.g., a methylcarbonyl group), an arylcarbonyl group [e.g., a phenylcarbonyl group), a sulfonamido group (e.g., an alkylsulfonamido group, and an arylsulfonamido group), a carbamoyl group (e.g., an ethylcarbamoyl group, a dimethylcarbamoyl group, an N-methylphenylcarbamoyl group, and an N-phenylcarbamoyl group), a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group, a hydroxyl group, a mercapto group, a halogen atom or a sulfo group.

$R_{25}$ is a hydrogen atom or contains from 1 to 32 carbon atoms, preferably from 1 to 22 carbon atoms and is a straight or branched alkyl group, an alkenyl group, a cyclic alkyl group, an aralkyl group or a cyclic alkenyl group. These groups may contain substituents as described for $R_{24}$.

$R_{25}$ may represent an aryl group, or a heterocyclic group. These groups may contain substituents as described for $R_{24}$.

In addition, $R_{25}$ may be a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group or a mercapto group.

$R_{26}$, $R_{27}$ and $R_{28}$ each represents groups as used for the usual 4-equivalent type phenol or α-naphthol couplers. In greater detail, $R_{26}$ is a hydrogen atom, a halogen atom, an aliphatic hydrocarbon residue, an acylamino group, —O—$R_{29}$ or —S—$R_{29}$ (wherein $R_{29}$ is an aliphatic hydrocarbon residue). When there are two or more $R_{26}$ groups in the same molecule, they may be different. The aliphatic hydrocarbon residue includes those containing a substituent(s). $R_{27}$ and $R_{28}$ are each an aliphatic hydrocarbon residue, an aryl group or a heterocyclic residue. One of $R_{27}$ and $R_{28}$ may be a hydrogen atom, and the above-described groups for $R_{27}$ and $R_{28}$ may be substituted. $R_{27}$ and $R_{28}$ may combine together to form a nitrogen-containing heterocyclic nucleus.

m is an integer of from 1 to 4, n is an integer of from 1 to 3, and p is an integer of from 1 to 5.

The aliphatic hydrocarbon residue may be saturated or unsaturated, or straight, branched or cyclic. Preferred examples are an alkyl group (e.g., a methyl group, an ethyl group, a propyl group, an isopropyl group, a butyl group, a tert-butyl group, an isobutyl group, a dodecyl group, an octadecyl group, a cyclobutyl group, and a cyclohexyl group), and an alkenyl group (e.g., an allyl group, and an octenyl group) The aryl group includes a phenyl group and a naphthyl group, and typical examples of heterocyclic residues are a pyridinyl group, a quinolyl group, a thienyl group, a piperidyl group and an imidazolyl group. Substituents to be introduced to these aliphatic hydrocarbon, aryl, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group and a morpholino group.

In the general formulae (XXX) to (XXXVIII), the substituents, $R_{20}$, $R_{21}$, $R_{22}$, $R_{24}$, $R_{25}$, $R_{26}$, $R_{27}$ and $R_{28}$, may combine together to form symmetrical or asymmetrical composite couplers, or any of the substituents may become a divalent group to form symmetrical or asymmetrical composite couplers.

Suitable examples of the couplers represented by the general formula (1) are shown below.

Yellow Coupler (Y-1)

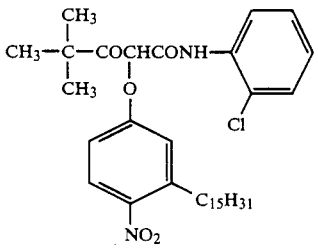

(Y-2)

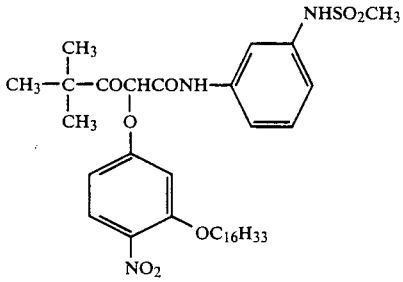

-continued
(Y-3)
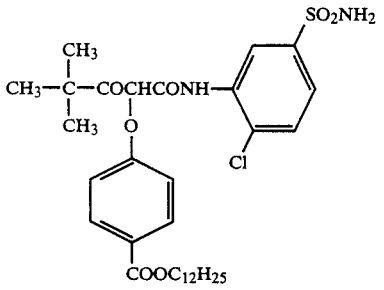
(Y-4)
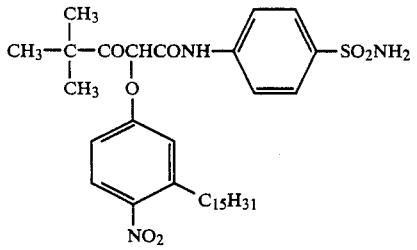
(Y-5)
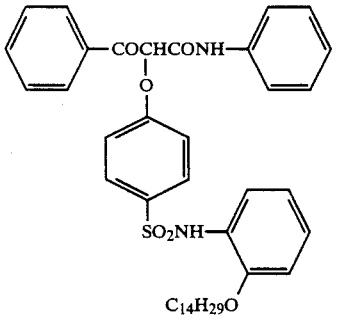
(Y-6)
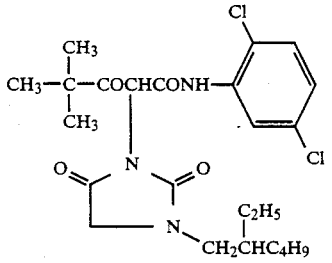
(Y-7)
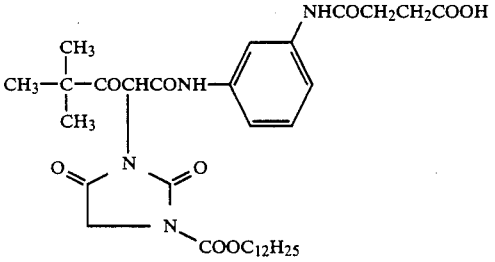

-continued
(Y-8)
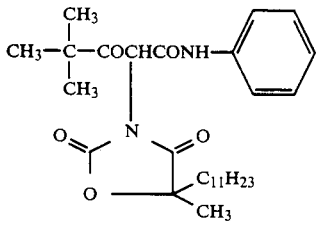
(Y-9)
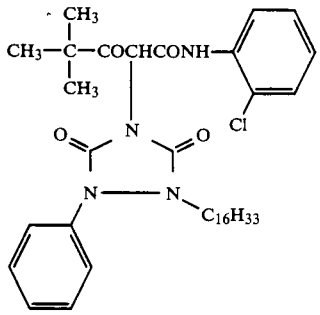
(Y-10)
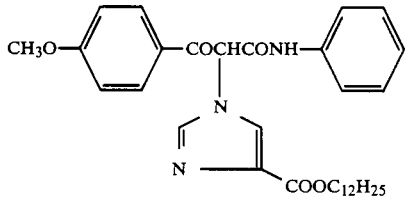
(Y-11)
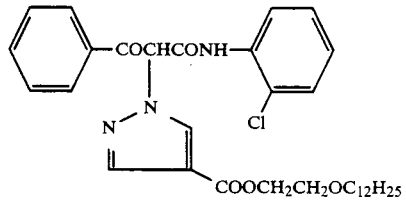
(Y-12)
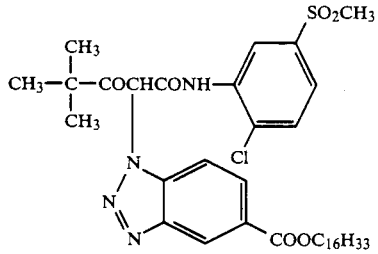
(Y-13)
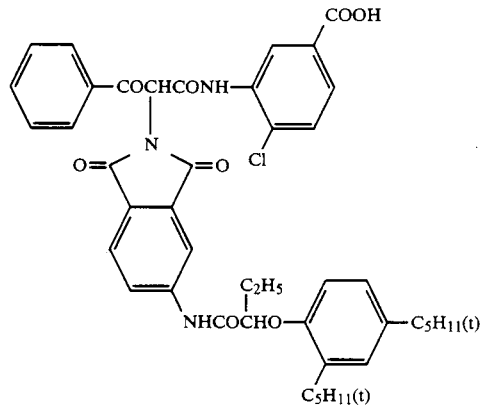

-continued
(Y-14)
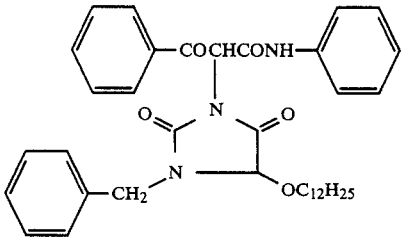
(Y-15)
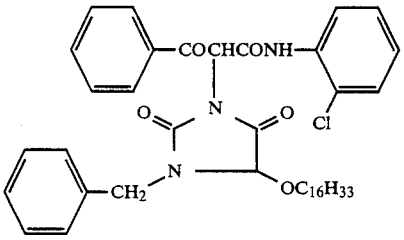
Magenta Coupler
(M-1)
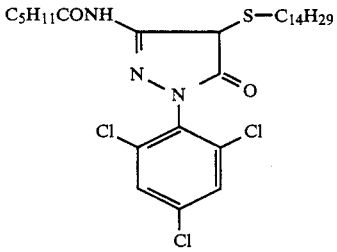
(M-2)
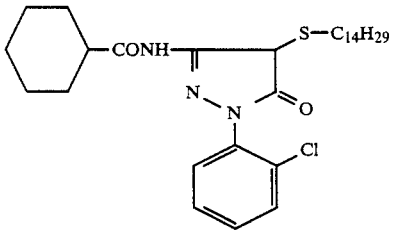
(M-3)
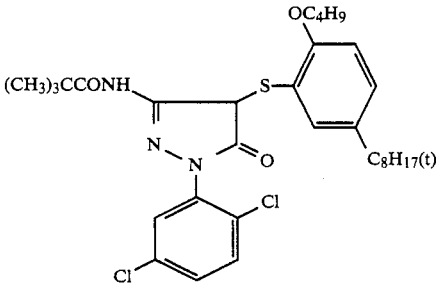
(M-4)
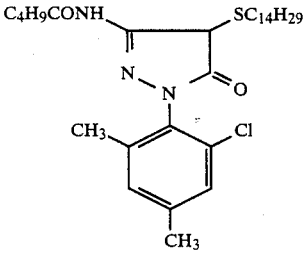

-continued
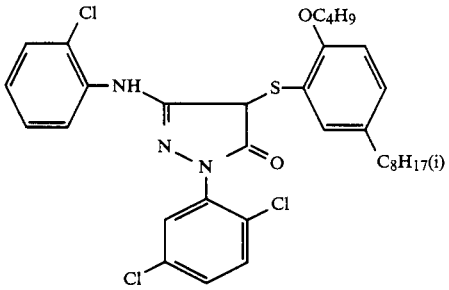
(M-5)
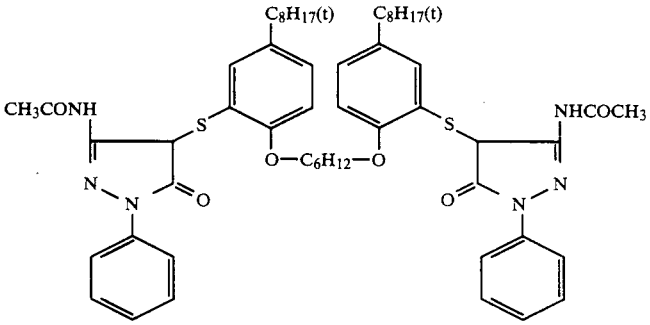
(M-6)
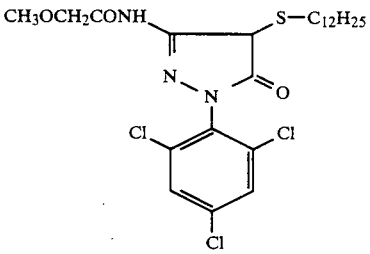
(M-7)
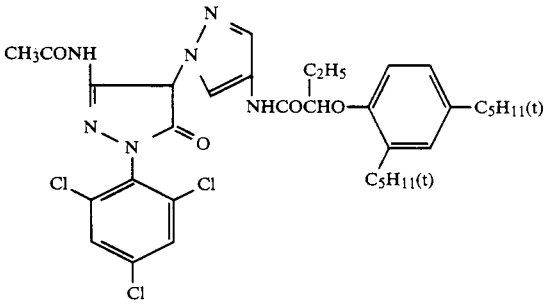
(M-8)
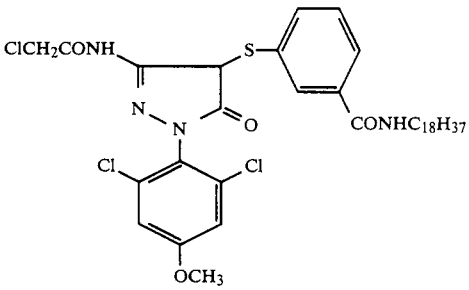
(M-9)

-continued
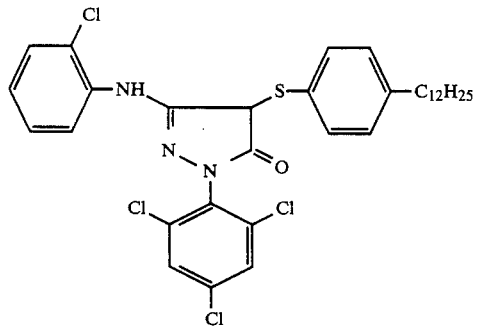
(M-10)
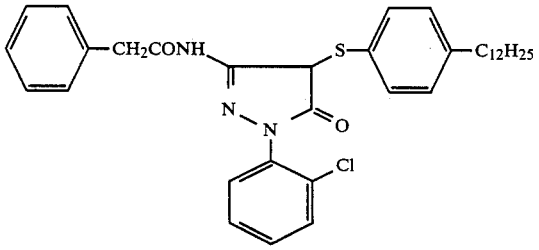
(M-11)
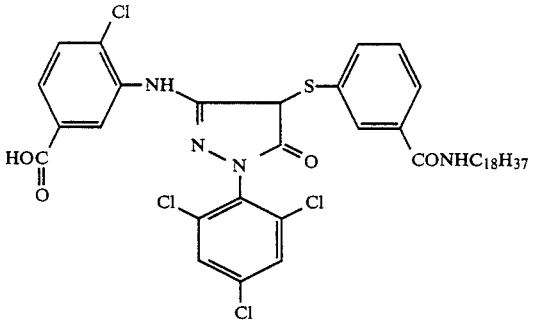
(M-12)
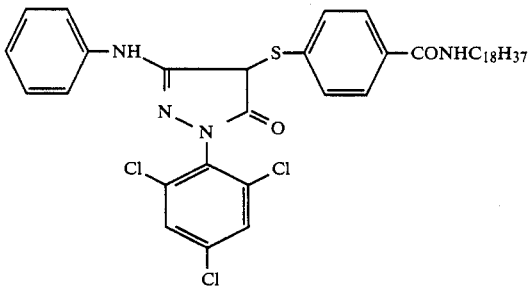
(M-13)
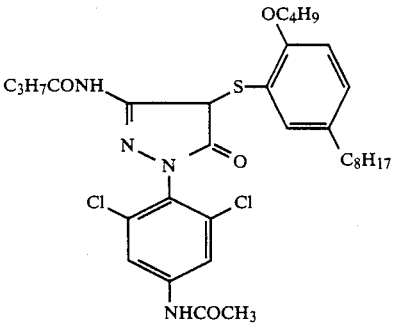
(M-14)

-continued
(M-15)
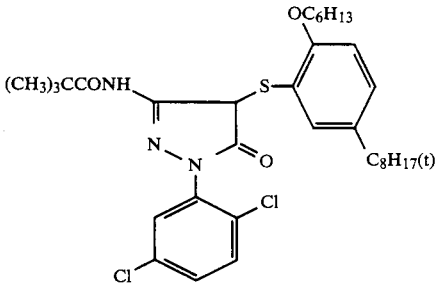
(M-16)
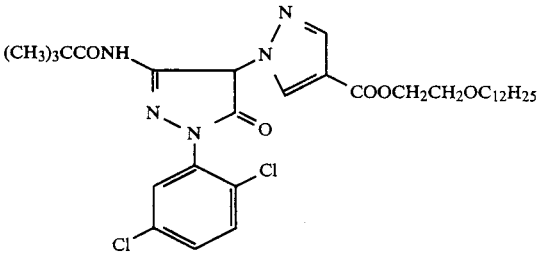
These compounds can be prepared by methods as described in, for example, U.S. Pat. Nos. 4,264,723, 3,227,554, 4,310,619 and 4,301,235, and Japanese Patent Application (OPI) Nos. 4044/82, 126833/81 and 122935/75.
Cyan Coupler
(C-1)
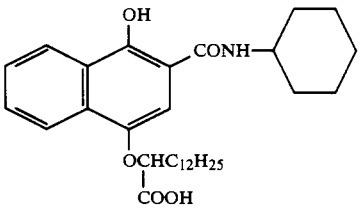
(C-2)
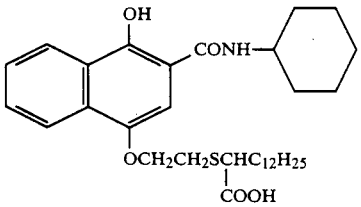
(C-3)
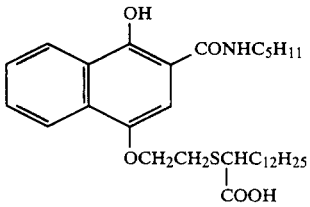
(C-4)
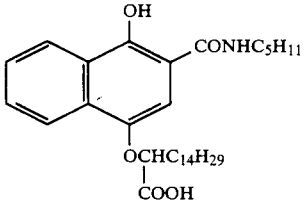
-continued
Cyan Coupler
(C-5)
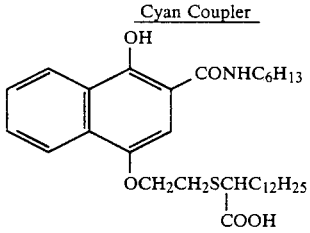
(C-6)
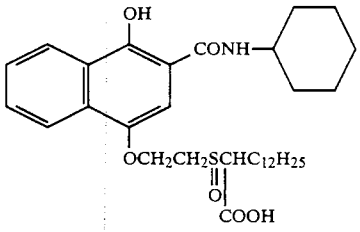
(C-7)
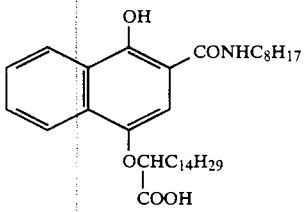
(C-8)
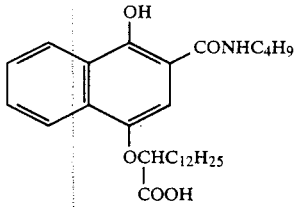

-continued
Cyan Coupler
(C-9)
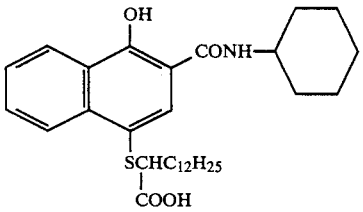
(C-10)
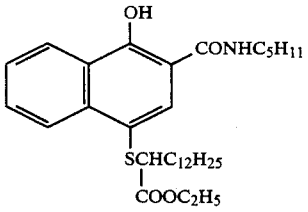
(C-11)
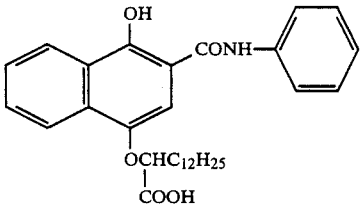
(C-12)
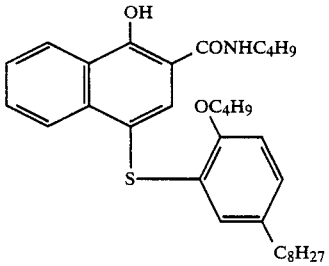
(C-13)
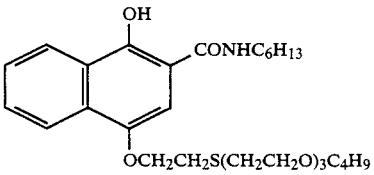
(C-14)
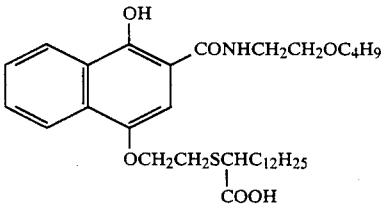
(C-15)
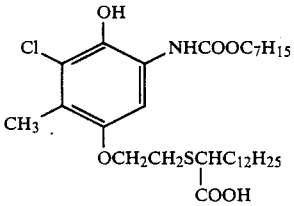
-continued
Cyan Coupler
(C-16)
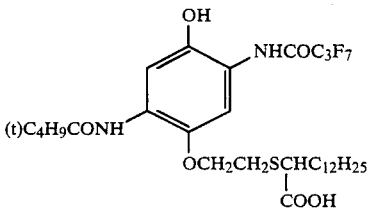
(C-17)
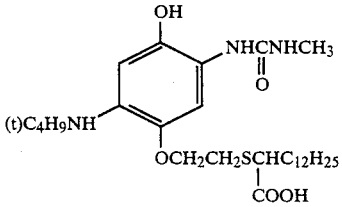
(C-18)
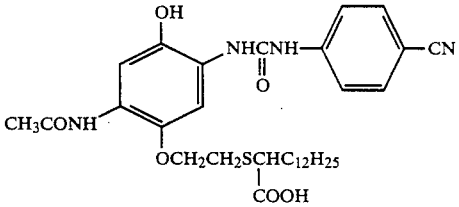
(C-19)
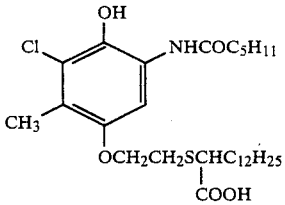
These compounds can be easily prepared by methods as described in, for example, Japanese Patent Application (OPI) Nos. 1938/81, 3934/82 and 105226/78.
(C-20)
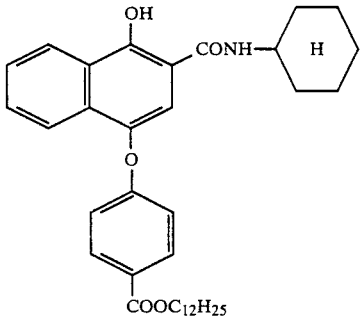
(C-21)
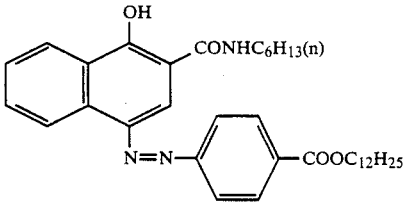

-continued
(C-22)
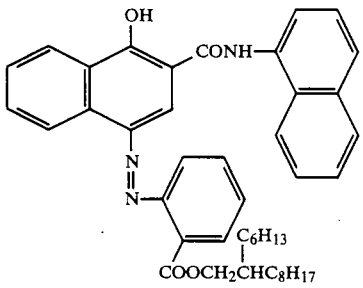
(C-23)
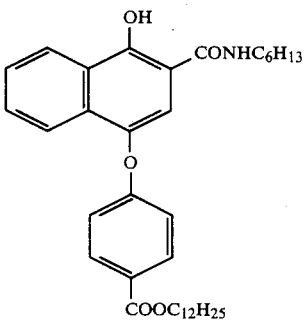
-continued
(C-24)
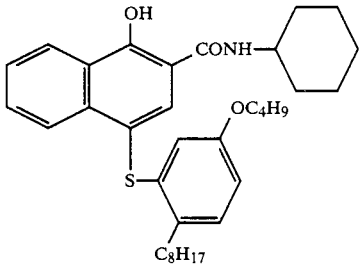
Preferred diffusing DIR compounds are shown below.
(D-1)
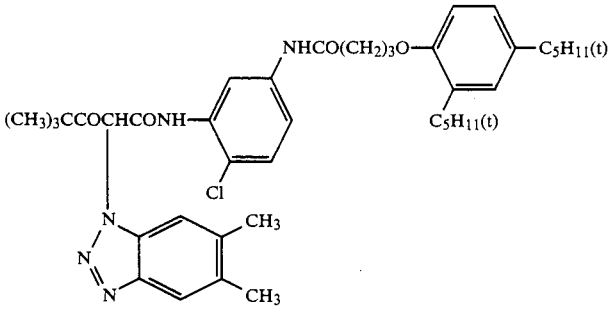
(D-2)
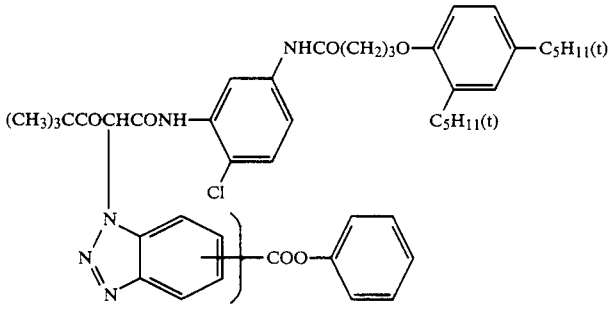
(D-3)
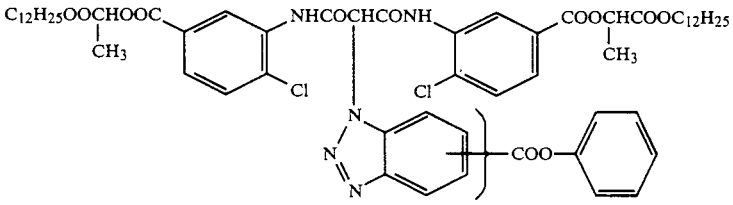

-continued
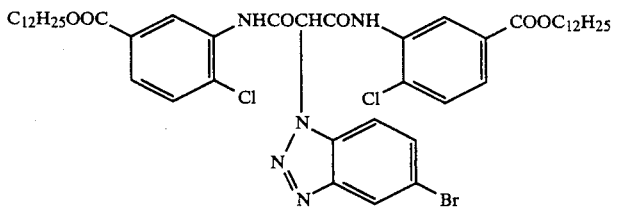
(D-4)
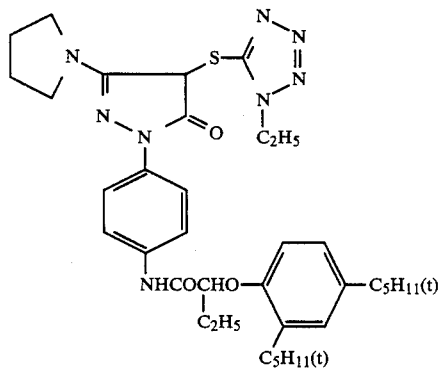
(D-5)
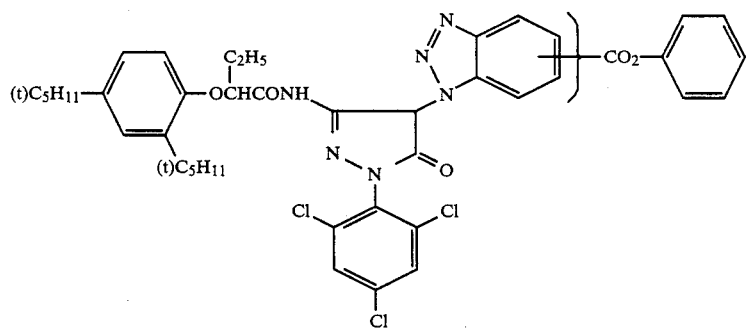
(D-6)
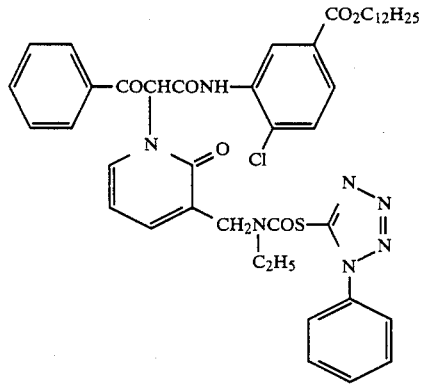
(D-7)
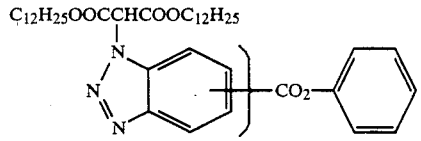
(D-8)

-continued
(D-9)
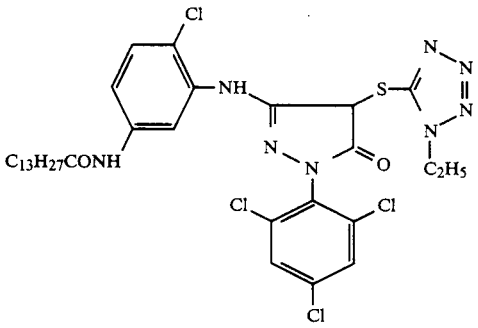
(D-10)
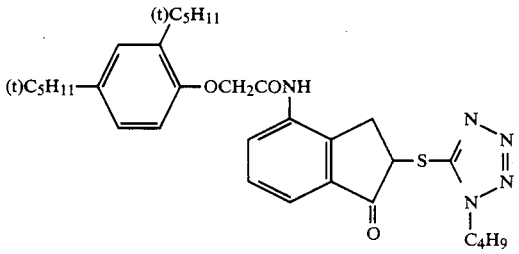
(D-11)
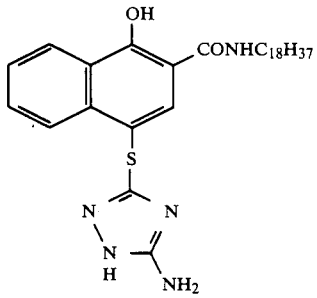
(D-12)
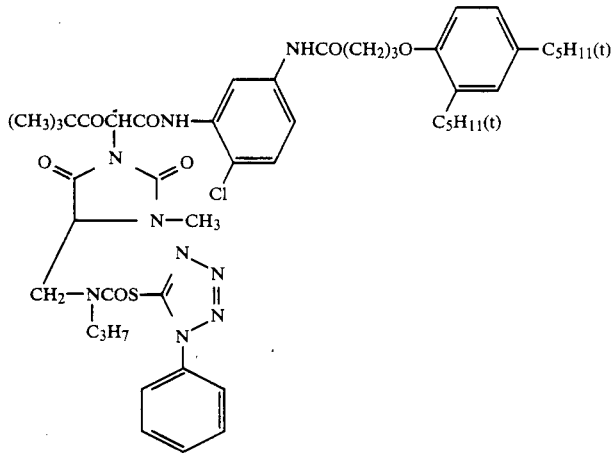

-continued
(D-13)
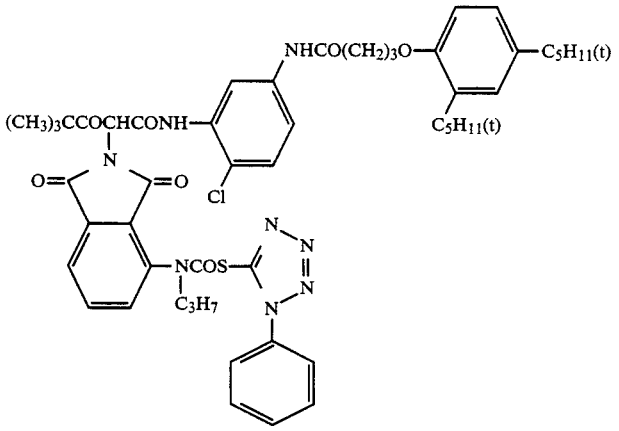
(D-14)
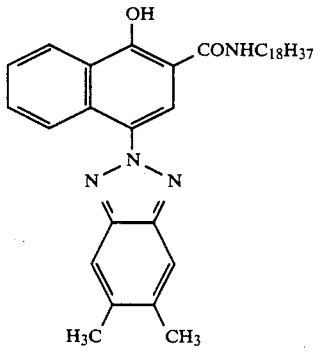
(D-15)
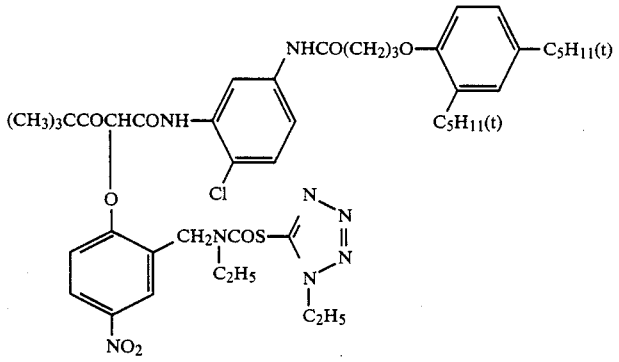
(D-16)
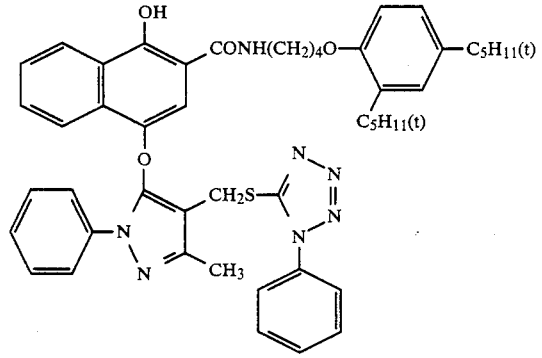

-continued
(D-17)
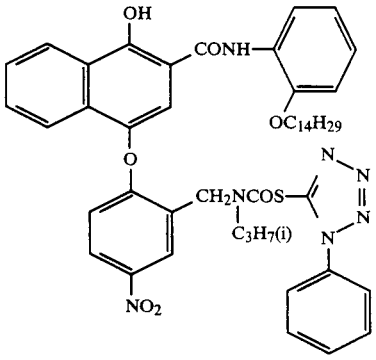
(D-18)
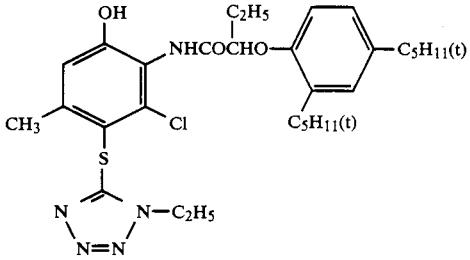
(D-19)
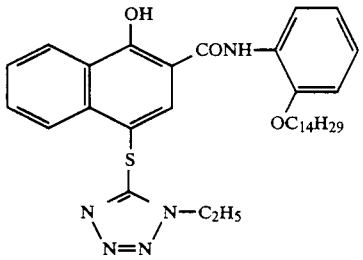
(D-20)
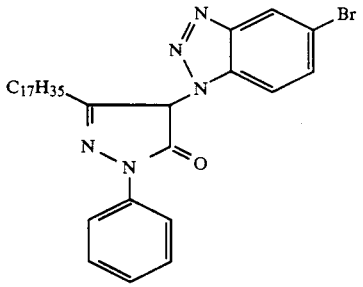
(D-21)
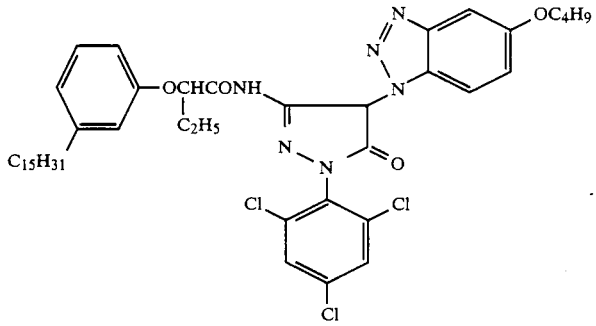

-continued
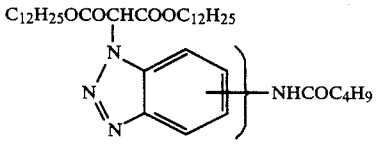
(D-22)
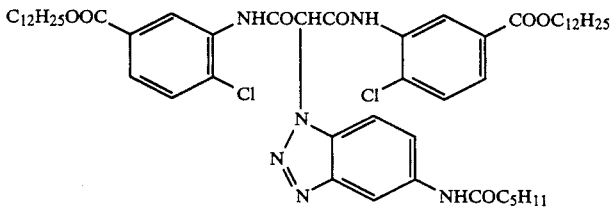
(D-23)
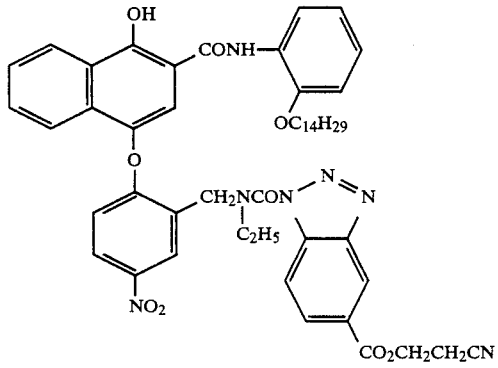
(D-24)
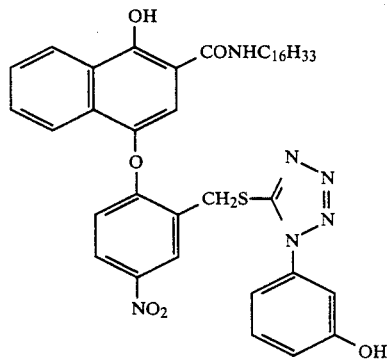
(D-25)
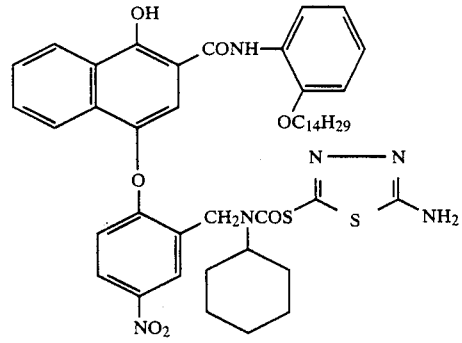
(D-26)

-continued
(D-27)
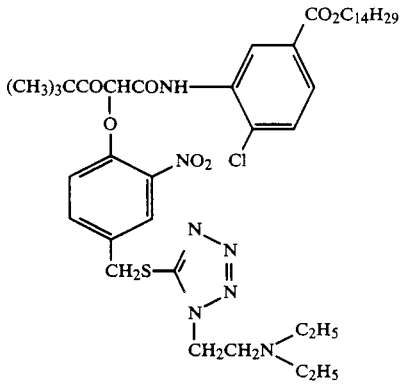
(D-28)
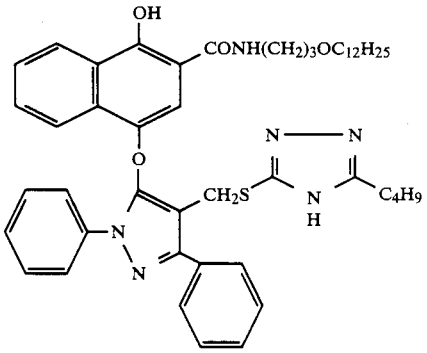
(D-29)
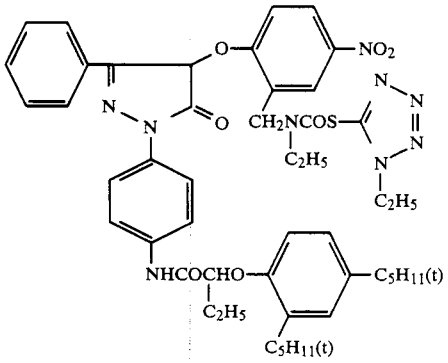
(D-30)
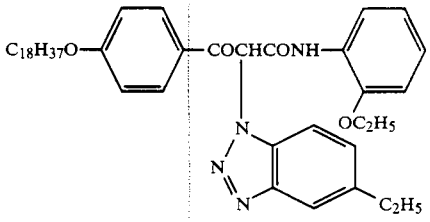
(D-31)
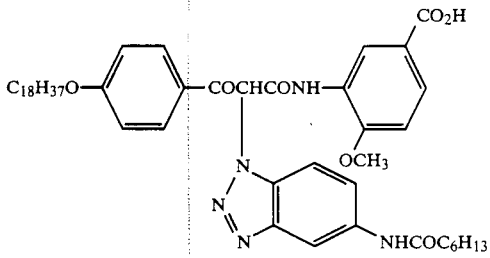

-continued
(D-32)
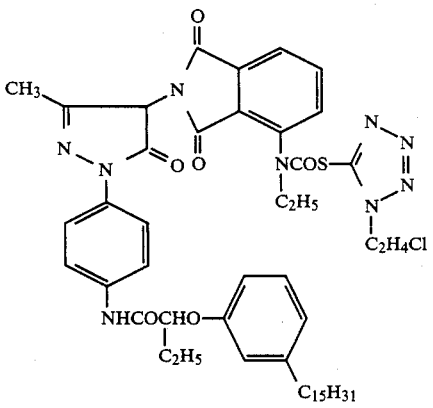
(D-33)
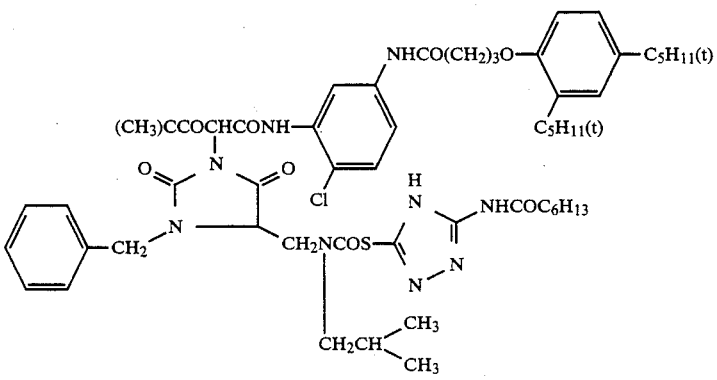
(D-34)
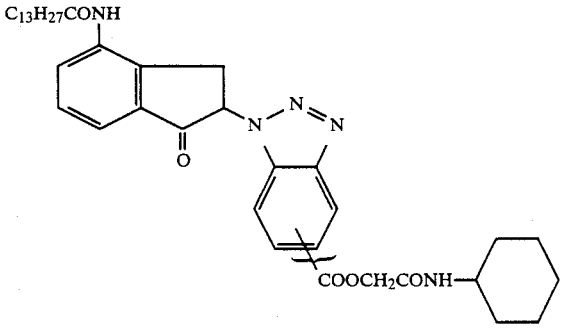
(D-35)
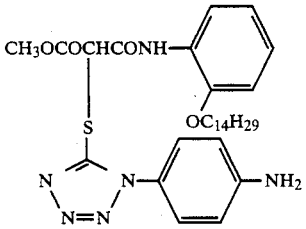

-continued
(D-36)
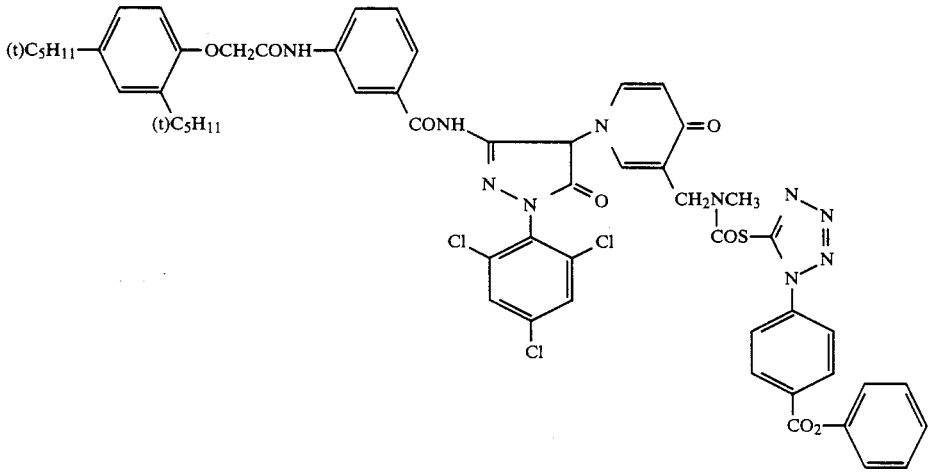
(D-37)
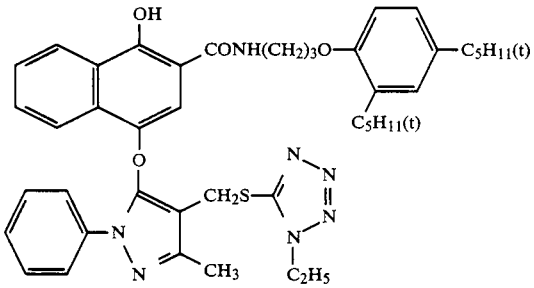
(D-38)
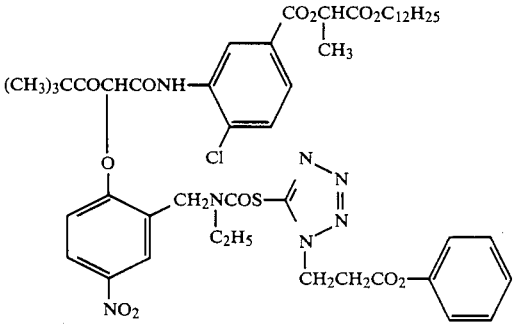
(D-39)
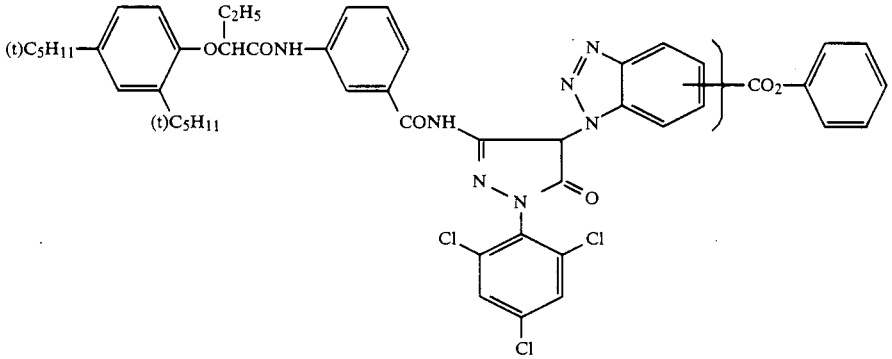

-continued
(D-40)
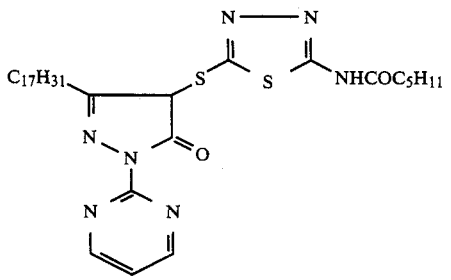
(D-41)
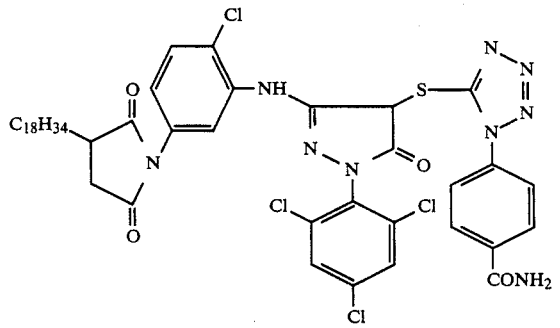
(D-42)
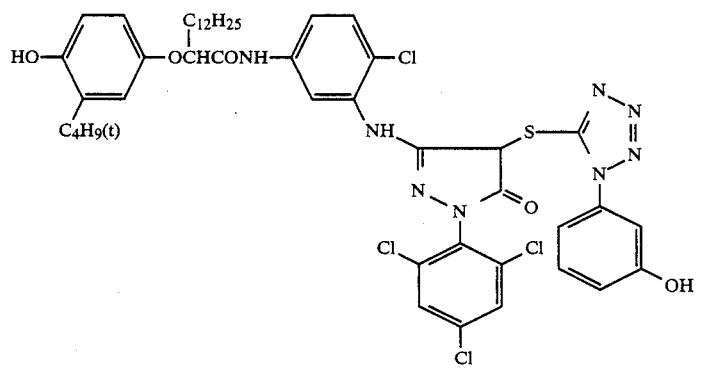
(D-43)
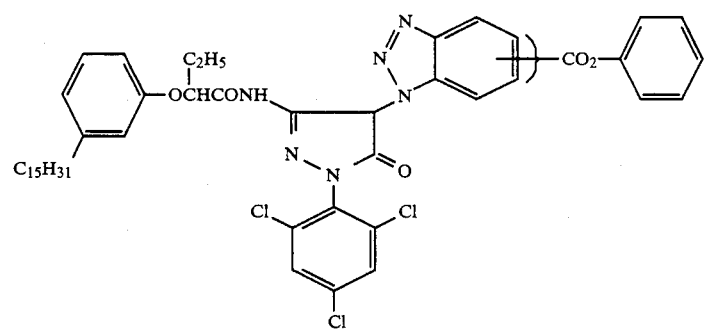
(D-44)
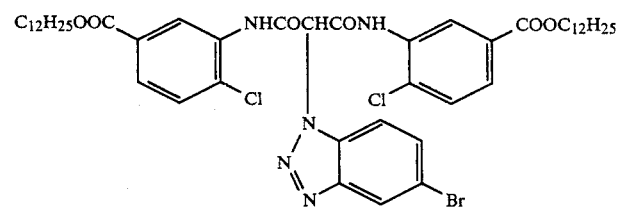

-continued

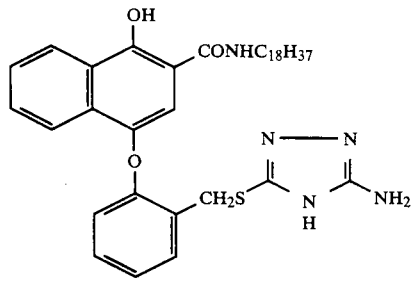

(D-45)

These compounds can be easily prepared by methods as described in, for example, U.S. Pat. Nos. 4,234,678, 3,227,554, 3,617,291, 3,958,993, 4,149,886 and 3,933,500, Japanese Patent Application (OPI) Nos. 56837/82 and 13239/76, British Patent Nos. 2,072,363 and 2,070,266, and *Research Disclosure*, No. 21228, December, 1981.

The coupler can be incorporated in a silver halide emulsion layer by any known technique, such as the method described in U.S. Pat. No. 2,322,027. For example, the coupler is dissolved in, for example, phthalic acid alkyl esters (e.g., dibutyl phthalate and dioctyl phthalate), phosphoric acid esters (e.g., diphenyl phosphate, triphenyl phosphate, tricresyl phosphate and dioctylbutyl phosphate), citric acid esters (e.g., tributyl acetylcitrate), benzoic acid esters (e.g., octyl benzoate), alkylamides (e.g., diethyllaurylamide), aliphatic acid esters (e.g., dibutoxyethyl succinate and dioctyl azelate), or trimesic acid esters (e.g., tributyl trimesicate), or organic solvents having a boiling point of from about 30 to about 150° C, for example, lower alkyl acetates such as ethyl acetate and butyl acetate, ethyl propionate, sec-butyl alcohol, methyl isobutyl ketone, $\beta$-ethoxyethyl acetate, and methyl cellosolve acetate and, thereafter, is dispersed in hydrophilic colloid The above-described high boiling and low boiling organic solvents may be used in combination with each other In addition, a dispersion procedure using polymers, as described in Japanese Patent Publication No. 39853/76 and Japanese Patent Application (OPI) No. 59943/76, can be used.

When the coupler contains an acid group, e.g., a carboxyl group and a sulfonyl group, it is incorporated in hydrophilic colloid in the form of an alkali aqueous solution.

High boiling organic solvents which can be used are described in, for example, U.S. Pat. Nos. 2,322,027, 2,533,514, 2,835,579, Japanese Patent Publication No. 23233/71, U.S. Pat. No. 3,287,134, British Patent No. 958,441, Japanese Patent Application (OPI) No. 1031/72, British Patent No. 1,222,753, U.S. Pat. No. 3,936,303, Japanese Patent Application [OPI) Nos. 26037/76, 82078/75, U.S Pat. Nos. 2,353,262, 2,852,383, 3,554,755, 3,676,137, 3,676,142, 3,700,454, 3,748,141, 3,837,863, German Patent (OLS) No. 2,538,889, Japanese Patent Application (OPI) Nos. 27921/76, 27922/76, 26035/76, 26036/76, 62632/75, Japanese Patent Publication No. 29461/74, U.S. Pat. Nos. 3,936,303, 3,748,141, and Japanese Patent Application (OPI) No. 1521/78.

As a binder or protective colloid for photographic emulsions, it is advantageous to use gelatin, although other hydrophilic colloids can be used. For example, proteins, such as gelatin derivatives, graft polymers of gelatin and other polymers, albumin and casein; cellulose derivatives, such as hydroxyethyl cellulose, carboxymethyl cellulose, and cellulose sulfuric acid esters; sugar derivatives, such as sodium alginate starch derivatives; and a wide variety of hydrophilic synthetic homo- or copolymers, such as polyvinyl alcohol, polyvinyl alcohol partial acetal, poly(N-vinyl) pyrrolidone, polyacrylic acid, polymethacrylic acid, polyacrylamide, polyvinyl imidazole, and polyvinyl pyrazole, can be used.

In addition to lime-processed gelatin, acid-processed gelatin and enzyme-processed gelatin as described in *Bull Soc. Sci. Phot. Japan*, No. 16, page 30 (1966) may be used as gelatin. In addition, hydroziates and enzymatic decomposition products of gelatin can be used.

Gelatin derivatives which can be used are those prepared by reacting gelatin with, e.g., acid halide, acid anhydride, isocyanates, bromoacetic acid, alkanesultones, vinylsulfonamides, maleimide compounds, polyalkylene oxides, and epoxy compounds. Typical examples are described in, for example, U.S. Pat. Nos. 2,614,928, 3,132,945, 3,186,846, 3,312,553, British Patent Nos. 861,414, 1,033,189, 1,005,784, and Japanese Patent Publication No. 26845/67.

Gelatin graft polymers which can be used are those compounds resulting from graft polymerization of homo- or copolymers of vinyl-based monomers, such as acrylic acid, methacrylic acid, their ester, amido or like derivatives, acrylonitrile, and styrene, on gelatin. In particular, graft polymers of gelatin and polymers of, e.g., acrylic acid, methacrylic acid, acrylamide, methacrylamide, or hydroxyalkyl methacrylate, having certain compatibility with gelatin are preferred. These examples are described in, for example, U.S. Pat. Nos. 2,763,625, 2,831,767 and 2,956,884.

Typical examples of hydrophilic syntheticpolymers are described in, for example, West German Patent Application (OLS) No. 2,312,708, U.S. Pat. Nos. 3,620,751, 3,879,205 and Japanese Patent Publication No. 7561/68.

In the photographic emulsion layer of the color photographic light-sensitive material of the invention, any of silver bromide, silver iodobromide, silver iodochlorobromide, silver chlorobromide, and silver chloride can be used as the silver halide A preferred example is silver iodobromide containing 15 mole % or less of silver iodide. Particularly preferred is silver iodobromide containing from 2 to 12 mole % of silver iodide.

Although the mean grain size of silver halide particles in the photographic emulsion is not critical, it is preferably 3 $\mu$ or less. The mean grain size is determined herein with a grain diameter in those particles which are spherical or nearly spherical, and an edge length in those particles which are cubic as a grain size, and is expressed as a mean value calculated from projected areas.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof In addition, silver halide particles composed of those having different crystal structures may be used.

The inner portion and the surface layer of silver halide particles may be different in phase or may be of the same phase. These silver halide particles may be those in which a latent image is formed mainly on the surface thereof, or those in which a latent image is formed mainly in the interior thereof.

Photographic emulsions as used herein can be prepared in any suitable manner, e.g., by the methods described in P. Glafkides, *Chimide et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) That is, any of an acid process, a neutral process, an ammonia process, etc., can be employed.

Soluble silver salts and soluble halogen salts can be reacted by techniques such as a single jet process, a double jet process, and a combination thereof In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, rhodium salts or its complex salts, iron salts or its complex salts, and the like.

For removal of soluble salts from the emulsion after precipitate formation or physical ripening, a noodle rinsing process in which gelatin is gelatinized may be used In addition, a flocculation process utilizing inorganic salts, anionic surface active agents, anionic polymers (e.g., polystyrenesulfonic acid), or gelatin derivatives (e.g., acylated gelatin and carbamoylated gelatin) may be used.

Silver halide emulsions are usually chemically sensitized. For this chemical sensitization, for example, the methods described in H. Frieser ed., *Die Grundlagen der Photographischen Prozesse mit Silverhalogeniden*, Akademische Verlagsgesselschaft, pp. 675 to 734 (1968) can be used; sulfur sensitization using compounds (e.g., thiosulfates, thioureas, mercapto compounds and rhodanines) containing sulfur capable of reacting with active gelatin or silver, reduction sensitization using reducing substances (e.g., stannous salts, amines, hydrazine derivatives, formamidinesulfinic acid, and silane compounds, noble metal sensitization using noble metal compounds (e.g., complex salts of Group VIII metals in the Periodic Table, such as Pt, Ir and Pd, as well as gold complex salts), and so forth can be applied alone or in combination with each other The sulfur sensitization process is described in, for example, U.S. Pat. Nos. 1,574,944, 2,410,689, 2,278,947, 2,728,668 and 3,656,955; the reduction sensitization process, in, for example, U.S. Pat. Nos. 2,983,609, 2,419,974 and 4,054,458; and the noble metal sensitization process, in, for example, U.S. Pat. Nos. 2,399,083, 2,448,060, and British Patent No. 618,061.

Photographic emulsions as used herein may include various compounds for the purpose of preventing fog formation in light-sensitive material during the production, storage or photographic processing thereof, or of stabilizing photographic performance. For example, those compounds known as antifoggants or stabilizers can be incorporated, including azoles, such as benzothiazolium salts, nitroindazoles, triazoles, benzotriazoles, and benzimidazoles (particularly nitro- or halogen-substituted compounds), heterocyclic mercapto compounds, such as mercaptothiazoles, mercaptobenzothiazoles, mercaptobenzimidazoles, mercaptothiadiazoles, mercaptotetrazoles (particularly 1-phenyl-5-mercaptotetrazole), and mercaptopyridines, the foregoing heterocyclic mercapto compounds further containing a water-soluble group, e.g., a carboxyl group or a sulfone group, thioketo compounds, such as oxazolinethione azaindenes, such as tetraazaindenes (particularly 4-hydroxy-substituted (1,3,3a,7)tetraazaindenes), benzenethiosulfonic acids, and benzenethiosulfinic acids.

In connection with specific examples and methods of using them, publications such as U.S. Pat. Nos. 3,954,474, 3,982,947 and 4,021,248, and Japanese Patent Publication No. 28660/77 can be referred to.

In photographic emulsion layers or other hydrophilic colloid layers of the light-sensitive material of the invention can be incorporated various surface active agents as coating aids or for other various purposes, e.g., prevention of charging, improvement of slipping properties, acceleration of emulsification and dispersion, prevention of adhesion, and improvement of photographic characteristics (particularly development acceleration, high contrast, and sensitization).

Surface active agents which can be used are nonionic surface active agents, e.g., saponin (steroid-based), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts), glycidol derivatives (e.g., alkenylsuccinic acid polyglyceride and alkylphenol polyglyceride), aliphatic acid esters of polyhydric alcohols, and alkyl esters of sugar; anionic surface active agents containing acidic groups, such as a carboxyl group, a sulfo group, a phospho group, a sulfuric acid ester group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene-alkylphosphoric acid esters; amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g , alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layer of the color photographic light-sensitive material of the invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development. For example, the compounds described in, for example, U.S. Pat. Nos. 2,400,532, 2,423,549, 2,716,062, 3,617,280, 3,772,021, 3,808,003, and British Patent No. 1,488,991 can be used.

In photographic emulsion layers or other hydrophilic colloid layers of the photographic light-sensitive material of the invention can be incorporated water-insoluble or sparingly soluble synthetic polymer dispersions for the purpose of improving dimensional stability. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, and styrene, and copolymers of the foregoing monomers and acrylic acid, methacrylic acid, $\alpha$, $\beta$-unsaturated dicarboxylic acid, hydroxyalkyl acrylate or methacrylate, sulfoalkyl acrylate or methacrylate, and styrenesulfonic acid. For example, the polymers described in U.S. Pat. Nos. 2,376,005, 2,739,137, 2,853,457, 3,062,674, 3,411,911, 3,488,708, 3,525,620, 3,607,290, 3,635,715, 3,645,740, British Patent Nos. 1,186,699 and 1,307,373 can be used.

In photographic processing of layers composed of photographic emulsions in the color photographic light-sensitive material of the invention, any of known procedures and known processing solutions, e.g., those described in *Research Disclosure*, No. 176, pp. 28–30 (RD-17643), can be used This photographic processing may be a photographic processing (color photographic process) to form dye images depending on the purpose The processing temperature is usually chosen from between 18° C. and 50° C., although it may be lower than 18° C. or higher than 50° C.

As a specific developing technique, there may be used a method in which a developing agent is incorporated in a light-sensitive material, for example, in an emulsion layer, and the light-sensitive material is developed by treating in an alkali aqueous solution 0f developing agents, hydrophobic ones can be incorporated by various techniques, e.g., by the methods described in *Research Disclosure*, No. 169 (RD-16928), U.S. Pat. No. 2,739,890, British Patent No. 813,253, and West German Patent 1,547,763. This photographic processing may be performed in combination with a treatment of stabilizing silver salts using thiocyanic acid salts.

Any fixers which are generally used can be used in the invention. As fixing agents, thiosulfuric acid salts and thiocyanic acid salts, and in addition, organic sulfur compounds which are known effective as fixing agents can be used. These fixers may contain water-soluble aluminum salts as hardeners.

Formation of dye images can be achieved by the usual method. For example, a negative-positive method (described in, for example, *Journal of the Society of Motion Picture and Television Engineers*, Vol. 61, pp. 667–701 (1953)) can be employed.

Color developers are usually alkaline aqueous solutions containing color developing agents As these color developing agents, known primary aromatic amine compounds, e.g phenylenediamines such as 4-amino-N,N-diethylaniline, 3-methyl-4-amino-N,N-diethylaniline, 4-amino, 4- (--]amino-N-ethyl-N-8-hydroxyethylaniline, 3-methyl-4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoanomidoethylaniline, and 4-amino-3-methyl-N-ethyl-N-$\beta$-methoxyethylaniline, can be used.

In addition, the compounds described in L. F. A. Mason, *Photographic Processing Chemistry*, Focal Press, pp. 226–229 (1966), U.S. Pat. Nos. 2,193,015, 2,592,364, Japanese Patent Application (OPI) No. 64933/73, etc., may be used.

The color developers can further contain pH buffers, development inhibitors, antifoggants, and so forth. If necessary, hard water-softening agents, preservatives, organic solvents, development accelerators, dye-forming couplers, competitive couplers, foggants, auxiliary developing agents, tackifiers, polycarboxylic acid-based chelating agents, antioxidants and the like may be incorporated.

Specific examples of such additives are described in, for example, Research Disclosure (RD-17643), U.S. Pat. No. 4,083,723, and West German Patent (OLS) No. 2,622,950.

After the color development, the photographic emulsion layer is usually bleached. This bleach processing may be performed simultaneously with a fix processing, or they may be performed independently.

Bleaching agents which can be used include compounds of polyvalent metals, e.g., iron (III), cobalt (III), chromium (VI), and copper (II), peracids, quinones and nitroso compounds For example, ferricyanides; dichromates; organic complex salts of iron (III) or cobalt (III), e.g., complex salts of organic acids, such as aminopolycarboxylic acids (e.g., ethylenediaminetetraacetic acid, nitrilotriacetic acid and 1,3-diamino-2-propanoltetraacetic acid) or organic acids (e.g., citric acid, tartaric acid and malic acid); persulfates; permanganates; and nitrosophenol can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a combined bleach-fixing solution.

In bleaching or bleach-fixing solutions can be incorporated various additives, such as bleach accelerators as described in U.S. Pat. Nos. 3,042,520, 3,241,966, Japanese Patent Publication Nos. 8506/70 and 8836/70, and thiol compounds as described in Japanese Patent Application (OPI) No 65732/78.

Photographic emulsions as used herein may be spectrally sensitized with, for example, methine dyes Useful sensitizing dyes are described in, for example, German Patent No. 929,080, U.S Pat. Nos. 2,493,748, 2,503,776, 2,519,001, 2,912,329, 3,656,959, 3,672,897, 4,025,349, British Patent No. 1,242,588, and Japanese Patent Publication No. 14030/69. These sensitizing dyes may be used in the usual manner, or they may be used in combination with each other Combinations of sensitizing dyes are often used particularly for the purpose of supersensitization. Typical examples are described in U.S. Patents 2,688,545, 2,977,229, 3,397,060, 3,522,052, 3,527,641, 3,617,293, 3,628,964, 3,666,480, 3,672,898, 3,679,428, 3,814,609, 4,026,707, British Patent No. 1,344,281, Japanese Patent Publication Nos. 4936/68, 12375/78, Japanese Patent Application (OPI) Nos. 110618/77 and 109925/77.

In producing the color photographic light-sensitive material of the invention, the photographic emulsion layers and other layers are coated on a flexible support, e.g., a plastic film, paper, and cloth, or a rigid support, e.g., glass, porcelain and metal.

Useful examples of such flexible supports include films made of semisynthetic or synthetic polymers, such as cellulose nitrate, cellulose acetate, cellulose acetate butyrate, polystyrene, polyvinyl chloride, polyethylene terephthalate, and polycarbonate, and paper coated or laminated with a baryta layer or an α-olefin polymer (e.g., polyethylene, polypropylene, and an ethylene/butene copolymer). These supports may be colored with dyes or pigments, or be made black for the purpose of shielding light. The surface of the supports is generally subjected to an undercoating treatment to improve its adhesion to a photographic emulsion layer and the like. Before or after the undercoating treatment, the support surface may be subjected to corona discharge, ultraviolet irradiation, flame treatment and the like.

In producing the color photographic light-sensitive material of the invention, the photographic emulsion layers and other hydrophilic colloid layers can be coated on a support or another layer by any known coating techniques, such as dip coating, roller coating, curtain coating and extrusion coating It is advantageous to use the methods described in U.S. Pat. Nos. 2,681,294, 2,761,791 and 3,526,528.

The present invention includes a multilayer polycolor photographic material having at least two different spectral sensitivities This type of multilayer polycolor photographic material usually comprises a support, and at least one red-sensitive emulsion layer, at least one green-sensitive emulsion layer, and at least one blue-sensitive emulsion layer provided on the support. These emulsion layers can be provided in any desired order. Usually, a cyan-forming coupler is incorporated in the red-sensitive emulsion layer, a magenta-forming coupler in the green-sensitive emulsion layer, and a yellow-forming coupler in the blue-sensitive layer. In some cases, different combinations can be used.

The color photographic light-sensitive material of the invention is exposed to light by the usual method. For this exposure, a wide variety of known light sources, such as natural light (sunlight), a tungsten lamp, a fluorescent lamp, a mercury lamp, a xenon arc lamp, a carbon arc lamp, a xenon flash lamp, and a cathode ray tube flying spot, can be used. The exposure time may be, as a matter of course, between 1/1,000 and 1 second, which is used for the usual cameras or may be shorter than 1/1,000 second, for example, between $1/10^4$ and $1/10^6$ second using a xenon flash lamp or a cathode ray tube. In addition, it may be longer than 1 second. If necessary, a color filter can be used to control the spectral composition of light to be used for exposure. A laser beam can also be used. In addition, the color photographic light-sensitive material of the invention may be exposed to light emitted from a fluorescent body excited by electron ray X-ray, γ-ray, α-ray, etc.

In the photographic emulsion layers of the color photographic light-sensitive material of the invention, color-forming couplers, i.e., compounds capable of forming color through an oxidative coupling reaction with aromatic primary amine developing agents (e.g., phenylenediamine derivatives and aminophenol derivatives) at color development may be used in combination. Examples of magenta couplers include a 5-pyrazolone coupler, a pyrazolobenzimidazole coupler, a cyanoacetylcumaron coupler, and a chain-closed acylacetonitrile coupler; examples of yellow couplers include acylacetamide couplers (e.g., benzoylacetanilides and pivaloylacetanilides); and examples of cyan couplers include a naphthol coupler and a phenol coupler.

These couplers desirably have a hydrophobic group called a ballast group in the molecule thereof, being non-diffusing. The couplers may be either of 4-equivalent or 2-equivalent per silver ion. In addition, they may be colored couplers having a color correction effect, or couplers (so-called DIR couplers) releasing a development inhibitor as development advances Other than DIR couplers, colorless DIR coupling compounds, the coupling reaction product of which is colorless, and which release a development inhibitor may be incorporated.

Typical examples of magenta color-forming couplers are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, and 55122/78.

Typical examples of yellow color-forming couplers are described in, for example, U.S. Pat. Nos. 2,875,057, 3,265,506, 3,408,194, 3,551,155, 3,582,322, 3,725,072, 3,891,445, West German Patent 1,547,868, West German Patent Application (OLS) Nos. 2,219,917, 2,261,361, 2,414,006, British Patent 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Typical examples of cyan couplers are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77 and 90932/77.

Colored couplers which can be used are described in, for example, U.S. Pat. Nos. 3,476,560, 2,521,908, 3,034,892, Japanese Patent Publication Nos. 2016/69, 2335/63, 11304/67, 32461/69, Japanese Patent Application (OPI) Nos. 26034/76, 4212/77, and West German Patent Application (OLS) No. 2,418,959.

DIR couplers which can be used are described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Patent 953,454, Japanese Patent Application (OPI) Nos. 69624/77, 122335/74, and Japanese Patent Publication No. 16141/76.

In addition to DIR couplers, compounds capable of releasing a development inhibitor with an advance of development can be incorporated in the color photographic light-sensitive material For example, the compounds described in, for example, U.S. Pat. Nos. 3,297,445, 3,379,529, West German Patent Application (OLS) No. 2,417,914, Japanese Patent Application (OPI) Nos. 15271/77 and 9116/78 can be used.

The color photographic light-sensitive-material of the invention may contain inorganic or organic hardeners in the photographic emulsion layers and other hydrophilic colloid layers thereof. For example, chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine, and 1,3-vinylsulfonyl-2-propanol), active halogen compounds (2,4-dichloro-6-hydroxy-s-triazine), and mucohalogenic acids (e.g., mucochloric acid and mucophenoxychloric acid) can be used alone or in combination with each other.

In the color photographic light-sensitive material of the invention, when dyes, ultraviolet ray absorbers, and the like are incorporated in the hydrophilic colloid layers, they may be mordanted with cationic polymers or etc. For this purpose, the compounds described in, for example, British Patent No. 685,475, U.S Pat. Nos. 2,675,316, 2,839,401, 2,882,156, 3,048,487, 3,184,309, 3,445,231, West German Patent Application (OLS) No. 1,914,362, Japanese Patent Application (OPI) Nos. 47624/75 and 71332/75 can be used.

The color photographic light-sensitive material of the invention may contain therein hydroquinone derivatives, aminophenol derivatives, gallic acid derivatives, ascorbic acid derivatives, etc., as color antifoggants.

The color photographic light-sensitive material of the invention may contain ultraviolet absorbers in the hydrophilic colloid layer thereof. Ultraviolet absorbers which can be used include benzotriazole compounds substituted with an aryl group, 4-thiazolidone compounds, benzophenone compounds, cinnamic acid ester compounds, butadiene compounds, benzoxazole compounds, and the like In addition, polymers having an ultraviolet ray-absorbing ability can be used. These ultraviolet absorbers may be fixed in the foregoing colloid layer.

Typical examples of ultraviolet absorbers are described in, for example, U.S. Pat. Nos. 3,533,794, 3,314,794, 3,352,681, Japanese Patent Application (OPI) No. 2784/71, U.S. Pat. Nos. 3,705,805, 3,707,375, 4,045,229, 3,700,455, 3,499,762, and West German Patent Publication No. 1,547,863.

The color photographic light-sensitive material of the invention may contain water-soluble dyes in the hydrophilic colloid layer thereof as filter dye or for various purposes, e.g., irradiation prevention. Examples of such dyes include oxonol dyes, hemioxonol dyes, styryl dyes, merocyanine dyes, cyanine dyes, and azo dyes In particular, oxonol dyes, hemioxonol dyes, and merocyanine dyes are useful.

In addition, known discoloration inhibitors as described hereinafter can be used in combination. Color image stabilizers as used herein can be used alone or in combination with each other. Typical known discoloration inhibitors include hydroquinone derivatives, gallic acid derivatives, p-alkoxyphenols, p-oxyphenol derivatives, and bisphenols.

Specific examples of the hydroquinone derivatives are described in, for example, U.S. Pat. Nos. 2,360,290, 2,418,613, 2,675,314, 2,701,197, 2,704,713, 2,728,659, 2,732,300, 2,735,765, 2,710,801, 2,816,028 and British Patent No. 1,363,921.

Examples of the gallic acid derivatives are described in, for example, U.S. Pat. Nos. 3,457,079 and 3,069,262.

Examples of the p-alkoxyphenols are described in, for example, U.S. Pat Nos. 2,735,765, 3,698,909, Japanese Patent Publication Nos. 20977/74 and 6623/77.

Examples of the p-oxyphenol derivatives are described in, for example, U.S. Pat. Nos. 3,432,300, 3,573,050, 3,574,627, 3,764,337, Japanese Patent Application (OPI) Nos. 35633/77, 147434/77 and 152225/77.

Examples of the bisphenols are described in, for example, U.S. Pat. No. 3,700,455.

The following examples are given to illustrate the invention in greater detail.

EXAMPLE 1

A multilayer color photographic light-sensitive material, Sample 101, comprising a cellulose triacetate film support with the layers as described below provided thereon was produced.

Sample 101

1st Layer Antihalation Layer (AHL);
Gelatin layer containing black colloid silver
2nd Layer: Intermediate Layer (ML);
Gelatin layer containing an emulsified dispersion of 2,5-di-tert-octylhydroquinone
3rd Layer: First Red-Sensitive Emulsion Layer ($RL_1$)
Silver iodobromide emulsion (silver iodide: 5 mole%; mean grain diameter: 0.4 $\mu$), amount of silver coated: 1.79 g/m$^2$
Sensitizing Dye I, $6\times10^{-5}$ mole per mole of silver
Sensitizing Dye II, $1.5\times10^{-5}$ mole per mole of silver
Coupler (EX-1), 0.04 mole per mole of silver
Coupler (EX-5), 0.003 mole per mole of silver
Coupler (D-3), 0.0006 mole per mole of silver
4th Layer Second Red-Sensitive Emulsion Layer ($RL_2$)
Silver iodobromide emulsion (silver iodide: 7 mole%; mean grain diameter: 0.65 $\mu$), amount of silver coated 1.4 g/m$^2$
Sensitizing Dye I, $3\times10^{-5}$ mole per mole of silver
Sensitizing Dye II, $1.2\times10^{-5}$ mole per mole of silver
Coupler (EX-2), 0.02 mole per mole of silver
Coupler (EX-5), 0.0016 mole per mole of silver
5th Layer: Intermediate Layer (ML); Same as the 2nd layer.
6th Layer: First Green-Sensitive Emulsion Layer ($GL_1$)
Silver iodobromide emulsion (silver iodide: 4 mole%; mean grain diameter: 0.35 $\mu$) amount of silver coated: 1.5 g/m$^2$
Sensitizing Dye III, $3\times10^{-5}$ mole per mole of silver
Sensitizing Dye IV, $1\times10^{-5}$ mole per mole of silver
Coupler (EX-4), 0.05 mole per mole of silver
Coupler (EX-8), 0.008 mole per mole of silver
Coupler (D-3), 0.0015 mole per mole of silver
7th Layer Second Green-Sensitive Emulsion Layer ($GL_2$)
Silver iodobromide emulsion (silver iodide: 6 mole%; mean grain diameter: 0.6 $\mu$), amount of silver coated 1.6 g/m$^2$
Sensitizing Dye III, $2.5\times10^{-5}$ mole per mole of silver
Sensitizing Dye IV, $0.8\times10^{-5}$ mole per mole of silver
Coupler (EX-3), 0.003 mole per mole of silver
Coupler (M-3), 0.017 mole per mole of silver
8th Layer: Yellow Filter Layer (YFL);
Gelatin layer containing yellow colloid silver and a 2,5-di-tert-octylhydroquinine emulsified dispersion 9th Layer: First Blue-Sensitive Emulsion Layer ($BL_1$);
Silver iodobromide emulsion (silver iodide: 6 mole%; mean grain diameter: 0.3 μ), amount of silver coated: 1 5 g/m²
Coupler (EX-9), 0.25 mole per mole of silver
Coupler (D-3), 0.015 mole per mole of silver 10th Layer: Second Blue-Sensitive Emulsion Layer ($BL_2$);
Silver iodobromide emulsion (silver iodide: 6 mole%; mean grain diameter 0.7 μ), amount of silver coated: 1.1 g/m²
Coupler (EX-9) 0 06 mole per mole of silver 11th Layer: Protective Layer (PL); Gelatin layer containing trimethyl methacrylate particles (diameter: about 1.5 μ)

In each of the foregoing layers were incorporated a gelatin hardener, (H-1), and a surface active agent.

The sample produced in the manner as described above is called as "Sample 101".

The compounds as used herein are as follows:

Sensitizing Dye I: Anhydro-5,5'-dichloro-3,3'-di(γ-sulfopropyl)-9-ethyl-thiacarbocyaninehydroxide pyridinium salt Sensitizing Dye II: Anhydro-9-ethyl-3,3'-di(γ-sulfopropyl)-4,5,4',5'-dibenzothiacarbocyaninehydroxide triethylamine salt Sensitizing Dye III: Anhydro-9-ethyl-5,5'-dichloro-3,3'-di(γ-sulfopropyl)oxycarbocyanine sodium salt Sensitizing Dye IV: Anhydro-1,1'-diethyl-3,3'-di(β-[β-(γ-sulfopropoxy)ethoxy]ethyl)-imidazolocarbocyaninehydroxide sodium salt Coupler (EX-1)

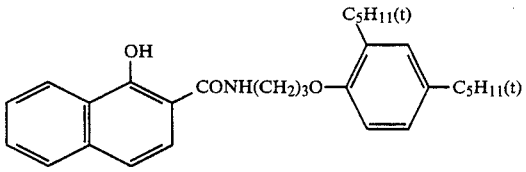

Coupler (EX-2)

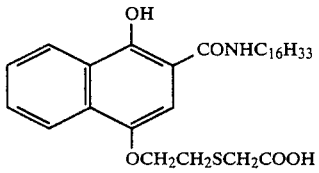

Coupler (EX-3)

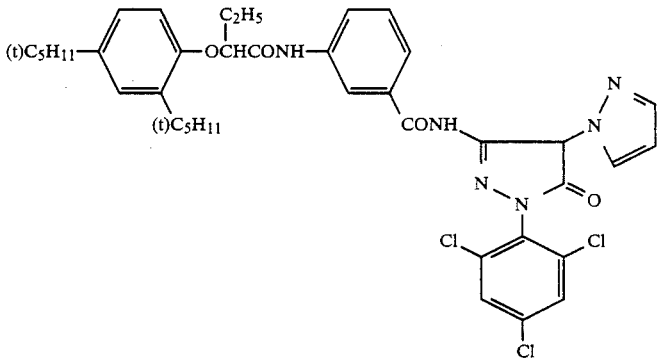

Coupler (EX-4)

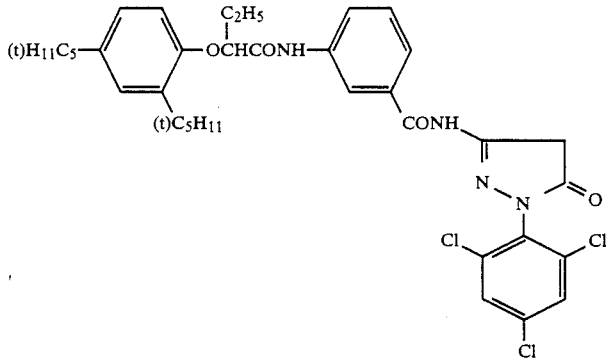

Coupler (EX-5)

-continued
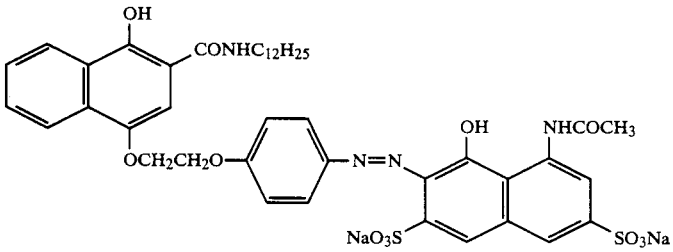
Coupler (EX-6)
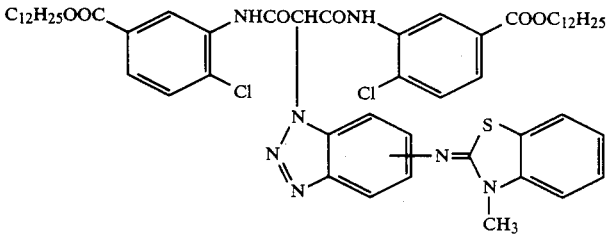
Coupler (EX-7)
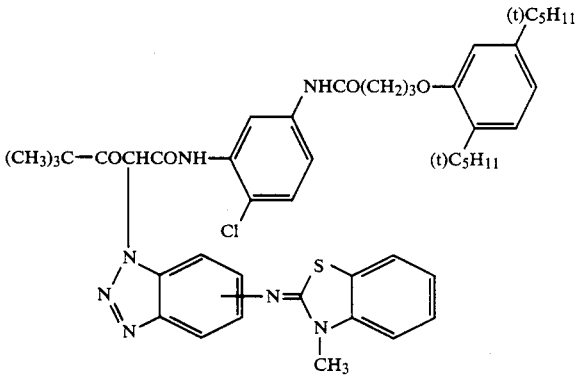
Coupler (EX-8)
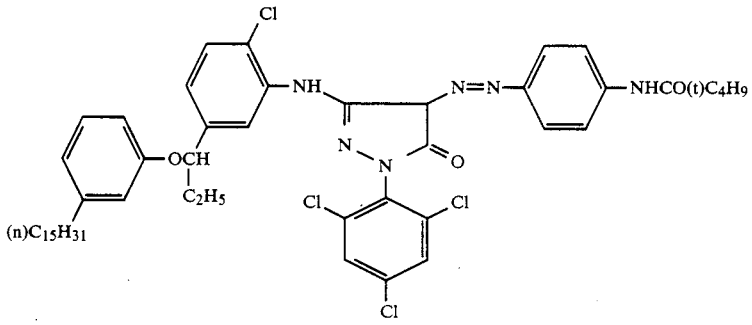
Coupler (EX-9)
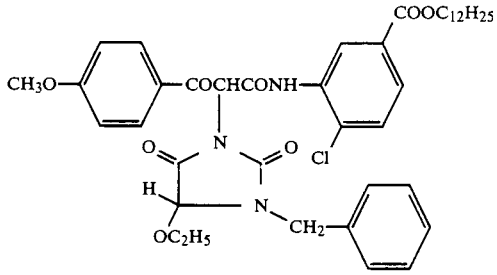
Coupler (EX-10)

-continued

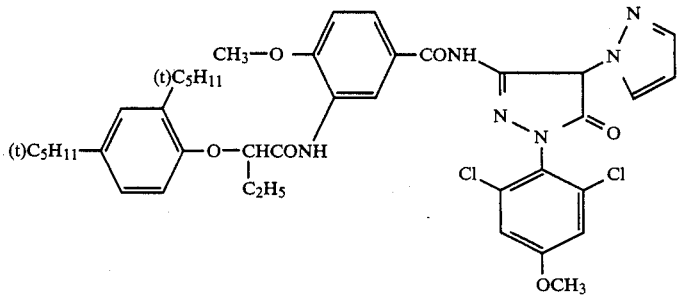

(H-1)

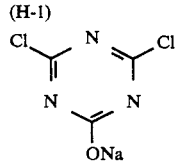

A series of light-sensitive materials Samples 102, 103 and 104, were produced as follows:

Sample 102

This light-sensitive material was produced in the same manner as in the production of Sample 101 except that Coupler (M-3) of $GL_2$ was replaced by an equimolar amount of Coupler (EX-10).

Sample 103 light-sensitive material was produced in the same manner as in Sample 101 except that Coupler (D-3) of each of RL, GL and BL was replaced by Coupler (EX-6).

Sample 104

This light-sensitive material was produced in the same manner as in Sample 101 except that Coupler (M-3) of GL was replaced by Coupler (EX-10), and Coupler (D-3) of each of RL, GL and BL was replaced by Coupler (EX-6).

Samples 101 through 104 showed nearly equal sensitivity and produced images of nearly equal gradation when exposed to white light through a wedge.

The granularity of magenta images in these light-sensitive materials was determined by the Root Mean Square (RMS) method The determination of granularity by the RMS method is well known to those skilled in the are, and is described in the article entitled "RMS Granularity; Determination of Just Noticeable Difference", *Photographic Science and Engineering*, Vol. 19, No. 4 (1975), pp. 235–238 In this determination, the aperture was 10 μ.

Moreover, the MTF value of GL at a frequency of 10 per millimeter was measured.

The results are shown in Table 2.

TABLE 2

| | Diffusing Dye-Forming Magenta Coupler | Diffusing DIR Coupler | RMS D = 0.3 + Fog* | RMS D = 1.0 + Fog* | MTF (magenta image) |
|---|---|---|---|---|---|
| Sample 101 (sample of this invention) | (M-3) (coupler of this invention | (D-3) (DIR of this invention) | 0.035 | 0.030 | 1.10 |
| Sample 102 (comparative example) | (EX-10) (comparative coupler) | (D-3) | 0.050 | 0.039 | 1.04 |
| Sample 103 (comparative example) | (M-3) | (EX-6) (comparative DIR coupler) | 0.035 | 0.030 | 0.85 |
| Sample 104 (comparative example) | (EX-10) | (EX-6) | 0.045 | 0.035 | 0.92 |

Note:
*fog: value of fog

Sample 101, a light-sensitive material of the invention, is superior in both granularity and sharpness. That is, reduction in both granularity and sharpness due to the use of Couplers (M-3) and (D-3) in combination does not occur and there is obtained an unexpected effect.

Coupler [D-3) was superior in sharpness, but inferior in granularity. That is, both MTF value and RMS value were large On the other hand, Coupler (M-3) was superior in granularity, but inferior in sharpness. That is, both MTF value and RMS value were small However, both granularity and sharpness were improved due to the use of Couplers (M-3) and (D-3) in combination. That is, the only good characteristics of these couplers appeared in the results. Further, the sharpness due to the use of these couplers in combination was superior to that due to the use of Coupler (D-3) alone.

Each light-sensitive material was processed at 38° C. as follows:

| | | |
|---|---|---|
| 1. | Color development | 3.25 min |
| 2. | Bleach | 6.5 min |

-continued

| | | |
|---|---|---|
| 3. | Rinsing | 3.25 min |
| 4. | Fixing | 6.5 min |
| 5. | Rinsing | 3.25 min |
| 6. | Stabilization | 3.25 min |

The processing solution used at each step was as follows.

| | | |
|---|---|---|
| Color Developer | | |
| Sodium nitrilotriacetate | 1.0 | g |
| Sodium sulfite | 4.0 | g |
| Sodium carbonate | 30.0 | g |
| Potassium bromide | 1.4 | g |
| Hydroxylamine sulfate | 2.4 | g |
| 4-(N-Ethyl-N-β-hydroxyethylamino)-2-methylaniline sulfate | 4.5 | g |
| Water to make | 1 | liter |
| Bleaching Solution | | |
| Ammonium bromide | 160.0 | g |
| Ammonia water (28%) | 25.0 | ml |
| Sodium iron ethylenediaminetetra-acetate | 130 | g |
| Glacial acetic acid | 14 | ml |
| Water to make | 1 | liter |
| Fixer | | |
| Sodium tetrapolyphosphate | 2.0 | g |
| Sodium sulfite | 4.0 | g |
| Ammonium thiosulfate (70%) | 175.0 | ml |
| Sodium disulfite | 4.6 | g |
| Water to make | 1 | liter |
| Stabilizer | | |
| Formalin | 8.0 | ml |
| Water to make | 1 | liter |

EXAMPLE 2

A light-sensitive material, Sample 201, comprising a 170 μ thick PET film support with the layers as described below provided on the support was produced.

Sample 201

The 1st, 2nd, 5th 8th and 10th to 12th layers were the same as the corresponding layers of Sample 101.

3rd Layer Same as the 3rd layer of Sample 101 except that Coupler (EX-7) was used in place of Coupler (D-3). 4th Layer: Same as the 4th layer of Sample 101 except that 0.005 mole of Coupler (EX-1) and 0.015 mole of Coupler (C-7) were used in place of Coupler (EX-2).

5th Layer: Same as the 6th layer of Sample 101 except that Coupler (EX-7) was used in place of Coupler (D-3).

6th Layer: Same as the 7th layer of Sample 101 except that 0.020 mole of Coupler (EX-3) was used in place of Couplers (EX-3) and (M-3).

9th Layer: Same as the 9th layer of Sample 101 except that Coupler (D-15) was used in place of Coupler (D-3).

As a hardener, H-2 having the following formula was used.

$$CH_2{=}CH{-}SO_2{-}CH_2CONHCH_2CH_2NHCOCH_2SO_2CH{=}CH_2$$

In addition, comparative light-sensitive materials, Samples 202, 203 and 204, were produced.

Sample 202

This light-sensitive material was produced in the same manner as in the production of Sample 201 except that the coupler in the 4th layer of Sample 201 was replaced by an equimolar amount (0.020 mole) of Coupler (EX-2).

Sample 203

This light-sensitive material was produced in the same manner as in Sample 201 except that Coupler (D-15) in the 9th layer of Sample 201 was replaced by a 2-fold molar amount of Coupler (EX-11).

Sample 204

This light-sensitive material was produced in the same manner as in Sample 201 except that the coupler in the 4th layer of Sample 201 was replaced by an equimolar amount (0.020 mole) of Coupler (EX-2), and Coupler (D-15) in the 9th layer was replaced by a 2-fold molar amount of Coupler (EX-11).

On exposing Samples 201 to 204 to white light through a wedge, RLs showed nearly equal sensitivity and the gradations of images formed therein were nearly equal. In GL and BL, however, the sensitivity and gradation were not equal since the interlayer effect of DIR Couplers (D-15) and (EX-11) was different.

With these light-sensitive materials, the granularity and MTF of RL were measured by the same method as in Example 1. In this determination, the aperture was 48 μ.

The results are shown in Table 3.

TABLE 3

| | Cyan Coupler | DIR Coupler | RMS (D = 0.3 + fog) | MTF (cyan image) |
|---|---|---|---|---|
| Sample 201 (example of this invention) | (C-7) | (D-15) | 0.014 | 0.99 |
| Sample 202 (comparative example) | (EX-2) | (D-15) | 0.022 | 0.94 |
| Sample 203 (comparative example) | (C-7) | (EX-11) | 0.014 | 0.80 |
| Sample 204 (comparative example) | (EX-2) | (EX-11) | 0.018 | 0.88 |

Sample 201, a light-sensitive material of the invention, is superior in both granularity and sharpness. In this material, the defects of each of Couplers (C-7) and (D-15) are completely compensated for, and it is observed that granularity and sharpness are further Coupler (EX-11).

Coupler (EX-11)

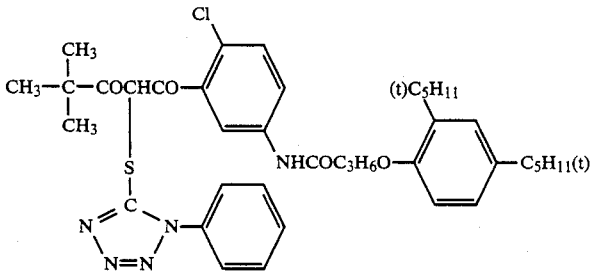

EXAMPLE 3

A series of light-sensitive materials, Samples 301 to 307, were produced in the same manner as in the production of Sample 101 of Example 1 except that Couplers (D-3) and (M-3) were replaced as shown in Table 4.

These light-sensitive materials, Samples 101 to 104 and 301 to 307, were processed in the same manner as in Example 1 and the granularity and sharpness were determined in the same manner as in Example 1.

The results are shown in Table 4.

TABLE 4

| Sample No. | Coupler 3rd Layer | Coupler 4th Layer | RMS (magenta image) D = 0.3 + Fog | MTF (magenta image) |
|---|---|---|---|---|
| 101 (example of the invention) | (D-3) | (M-3) | 0.035 | 1.10 |
| 301 (example of the invention) | (D-4) | (M-3) | 0.032 | 1.12 |
| 302 (example of the invention) | (D-16) | (M-3) | 0.035 | 0.99 |
| 303 (example of the invention) | (D-17) | (M-3) | 0.034 | 1.08 |
| 304 (comparative example) | (EX-12) | (M-3) | 0.035 | 0.98 |
| 103 (comparative example) | (EX-6) | (M-3) | 0.035 | 0.85 |
| 102 (comparative example) | (D-3) | (EX-10) | 0.050 | 1.37 |
| 305 (comparative example) | (D-17) | (EX-10) | 0.050 | 1.03 |
| 306 (comparative example) | (D-16) | (EX-10) | 0.047 | 0.99 |
| 307 (comparative example) | (EX-12) | (EX-10) | 0.042 | 1.00 |
| 104 (comparative example) | (EX-6) | (EX-10) | 0.045 | 0.92 |

It can be seen from Table 4 that in the combinations of the invention the granularity and sharpness are both increased to a high level and that the problem of reduction of sharpness encountered in using a diffusing dye-forming coupler as in Sample 306 can be completely overcome.

Moreover, it can be seen that when the diffusibility of a development inhibitor released is at least 0.4, the sharpness is further improved compared with the case in which a diffusing dye-forming coupler is not used.

Coupler (EX-12)

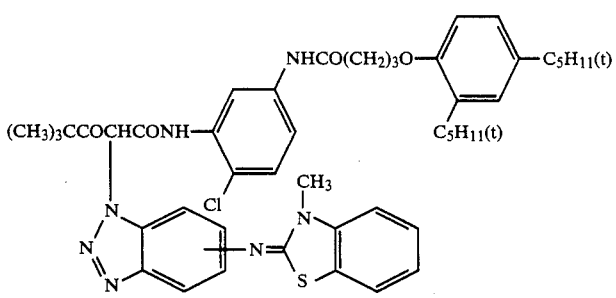

EXAMPLE 4

A color photographic light-sensitive material comprising a cellulose triacetate film support with the layers as described below provided on the support was produced. This light-sensitive material is called "Sample 401".

Sample 401

The 1st, 2nd and 4th to 11th layers were the same as the corresponding layers of Sample 104 produced in Example 1.

3rd Layer:

Silver iodobromide emulsion (silver iodide: 5 mole%; mean grain diameter: 0.4 μ), amount of silver coated: 1.79 g/m²

Coupler (EX-1), 0.03 mole per mole of silver

Coupler (C-2), 0.01 mole per mole of silver

Coupler (D-16), 0.0006 mole per mole of silver

The 5th layer had the same composition as that of the 11th layer of Example 1.

In addition, light-sensitive materials, Samples 402 to 404 were produced.

Sample 402

This light-sensitive material was produced in the same manner as in the production of Sample 401 except that Coupler (C-2) in the 3rd layer of Sample 401 was replaced by an equimolar amount of Coupler (EX-2).

Sample 403

This light-sensitive material was produced in the same manner as in Sample 401 except that Coupler (D-16) in the 3rd layer of Sample 401 was replaced by an equimolar amount of Coupler [EX-13) as described hereinafter.

Sample 404

This light-sensitive material was produced in the same manner as in Sample 401 except that Coupler (C-2) in the 3rd layer of Sample 401 was replaced by Coupler (EX-2), and Coupler (D-16) was replaced by an equimolar amount of Coupler (EX-13) as described hereinafter.

Samples 401 to 404, when exposed to white light through a wedge, provided nearly equal sensitivity and gradation.

With these materials, the granularity and MTF were measured by the same method as in Examples 1 and 2. The results are shown in Table 5.

TABLE 5

| Sample No. | RMS (R) D = 0.3 + Fog | MTF (R) at 10 per Millimeter |
|---|---|---|
| 401 (example of this invention) | 0.015 | 1.05 |
| 402 (comparative example) | 0.022 | 1.01 |
| 403 (comparative example) | 0.015 | 0.83 |
| 404 (comparative example) | 0.019 | 0.92 |

It is clearly understood that Sample 401, a light-sensitive material of the invention, is superior in both granularity and sharpness.

Coupler (EX-13)

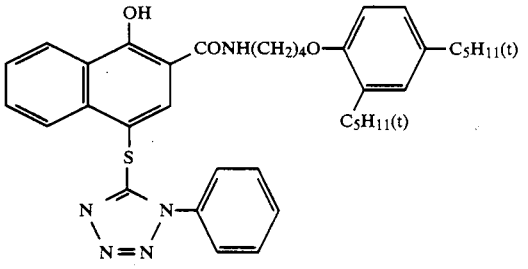

EXAMPLE 5

Light-sensitive materials, Samples 501 to 504, were produced in the same manner as in the production of Sample 401 except that Couplers (C-2) and (D-16) of the rd layer were replaced by equimolar amounts of couplers shown in Table 6.

When the above-produced light-sensitive materials were exposed to white light through a wedge and processed in the same manner as in Example 1, nearly equal sensitivity and gradation were obtained With these light-sensitive materials, the granularity and sharpness were measured by the same method as in Example 1.

The results are shown in Table 6 below.

TABLE 6

| Sample No | Couplers in 3rd Layer | RMS (cyan image) D = Fog + 0.3 | MTF (cyan image) 10/mm |
|---|---|---|---|
| 401 | (C-2) (D-16) | 0.015 | 1.05 |
| 501 | (C-10) (D-16) | 0.016 | 1.07 |
| 502 | (C-2) (D-12) | 0.014 | 1.06 |
| 503 | (C-2) (D-22) | 0.015 | 1.10 |
| 504 | (C-24) (D-25) | 0.015 | 1.06 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon two silver halide emulsion layers which have different speeds but have sensitivities in the same spectral region, wherein the lower speed light-sensitive emulsion layer comprises a non-diffusible coupler capable of forming a non-diffusible dye by reaction with an oxidation product of a color developing agent and a non-diffusible compound capable of releasing a development inhibitor by reaction with an oxidation product of a color developing agent, and the silver halide emulsion layer having the higher speed contains a non-diffusible coupler capable of producing a diffusible dye by reaction with an oxidation product of a color developing agent, wherein the two silver halide emulsion layers sensitive to the same spectral region are adjacently positioned, and wherein the silver halide emulsion layer having the higher speed further contains a non-diffusible coupler capable of forming a non-diffusible dye by reaction with an oxidation product of a color developing agent.

2. A silver halide photographic light-sensitive material comprising a support having thereon two silver halide emulsion layers which have different speeds but have sensitivities in the same spectral region, wherein the lower speed light-sensitive emulsion layer comprises a non-diffusible compound capable of releasing a development inhibitor by reaction with an oxidation product of a color developing agent, and the silver halide emulsion layer having the higher speed contains a non-diffusible coupler capable of producing a diffusible dye by reaction with an oxidation product of a color developing agent, wherein the two silver halide emulsion layers sensitive to the same spectral region are adjacently positioned and wherein a non-diffusible coupler capable of forming a non-diffusible dye by reaction with an oxidation product of a color developing agent is present in the same layer as or a different layer than the non-diffusible coupler capable of producing a diffusible dye.

* * * * *